US010900221B2

(12) United States Patent
McEndree et al.

(10) Patent No.: US 10,900,221 B2
(45) Date of Patent: Jan. 26, 2021

(54) MULTIFUNCTIONAL FLASHING DEVICE

(71) Applicant: James Hardie Technology Limited, Dublin (IE)

(72) Inventors: Michael McEndree, Akron, OH (US); Richard Klein, Yorba Linda, CA (US); Hui Li, Fontana, CA (US); Amol Joshi, Chino Hills, CA (US); Thayne Dye, Upland, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 16/717,898

(22) Filed: Dec. 17, 2019

(65) Prior Publication Data

US 2020/0199865 A1 Jun. 25, 2020

Related U.S. Application Data

(60) Provisional application No. 62/783,785, filed on Dec. 21, 2018.

(51) Int. Cl.
*E04B 1/64* (2006.01)

(52) U.S. Cl.
CPC ..... *E04B 1/64* (2013.01)

(58) Field of Classification Search
CPC ..... E04F 13/0864; E04F 13/0889; E04F 21/1855; E04B 1/64
See application file for complete search history.

(56) References Cited

U.S. PATENT DOCUMENTS 2,292,984 A * 8/1942 Alvarez, Jr. ..... E04F 13/0803 52/471
2,293,744 A * 8/1942 Miles ..... E04F 13/007 52/547
4,155,175 A * 5/1979 Stiles ..... G01B 3/30 33/646
4,425,714 A * 1/1984 Kelly, Jr. ..... E04F 21/1855 33/646
4,698,942 A * 10/1987 Swartz ..... E04F 21/1855 52/547
5,586,415 A * 12/1996 Fisher ..... E06B 1/62 52/58
6,052,961 A * 4/2000 Gibbs ..... E04D 1/16 52/518
7,434,329 B2 * 10/2008 Walda ..... E04F 21/1855 33/649

(Continued)

*Primary Examiner* — Rodney Mintz
(74) *Attorney, Agent, or Firm* — Knobbe Martens Olson & Bear, LLP

(57) ABSTRACT

The present application is generally directed to multifunctional flashing devices suitable for installation of lap siding. Flashing devices include a flashing section, a removable supporting section, and one or more alignment features configured to facilitate positioning of the flashing devices adjacent to an installed course of lap siding. The flashing devices may be fastened to a building substrate adjacent to an installed course of lap siding, at locations corresponding to butt joints of an additional course of lap siding. The supporting sections of the flashing devices are configured to retain and support additional cladding elements in position for installation. When the additional cladding elements have been fastened to the building substrate, the supporting section may be removed from the flashing section.

23 Claims, 23 Drawing Sheets

(56) References Cited

U.S. PATENT DOCUMENTS 7,490,447 B2 * 2/2009 Ouellette ..... E04F 21/1855 33/645
7,584,587 B2 * 9/2009 Ouellette ..... E04F 13/0889 33/646
7,721,488 B1 * 5/2010 Bennett ..... E04F 13/0864 52/58
7,784,222 B2 * 8/2010 Bennett ..... E04F 13/0864 52/58
7,836,652 B2 * 11/2010 Futterman ..... E04F 13/04 52/417
8,448,401 B2 * 5/2013 Schaefer ..... E04F 13/0864 52/533
9,624,675 B2 * 4/2017 Schaefer ..... E04F 13/0832
9,951,514 B2 * 4/2018 Debuff ..... E04F 19/00
10,301,816 B2 * 5/2019 DeBuff ..... E04F 13/0833
10,544,578 B2 * 1/2020 DeBuff ..... E04F 19/00
2002/0023366 A1 * 2/2002 Bueno ..... E04D 1/2918 33/647
2002/0174618 A1 * 11/2002 Carroll ..... E04F 21/1855 52/520
2005/0262792 A1 * 12/2005 Walda ..... E04F 13/0864 52/547
2006/0269713 A1 * 11/2006 Zuege ..... B32B 27/32 428/40.1
2006/0272258 A1 * 12/2006 Pollock ..... E04F 21/1855 52/543
2007/0054086 A1 * 3/2007 Pagel ..... C08K 5/0008 428/106
2007/0068115 A1 * 3/2007 Ouellette ..... E04F 21/1855 52/749.1
2007/0157528 A1 * 7/2007 Gawoski ..... E06B 1/62 52/58
2008/0008880 A1 * 1/2008 Walda ..... E04F 21/1855 428/343
2008/0209834 A1 * 9/2008 Ouellette ..... E04F 21/1855 52/518
2008/0209851 A1 * 9/2008 Ouellette ..... E04F 13/0889 52/749.1
2008/0318019 A1 * 12/2008 Walda ..... E04F 21/1855 428/220
2009/0064599 A1 * 3/2009 Bennett ..... E04F 13/0864 52/60
2010/0218434 A1 * 9/2010 Bennett ..... E04F 13/0889 52/58
2012/0042604 A1 * 2/2012 Walda ..... E04F 21/1855 52/741.4
2012/0047837 A1 * 3/2012 Schaefer ..... E04F 13/0864 52/519
2014/0208679 A1 * 7/2014 Schaefer ..... E04F 13/0832 52/704
2016/0040435 A1 * 2/2016 Schaefer ..... E04F 13/0837 52/704
2016/0160497 A1 * 6/2016 Randlett ..... E04F 13/007 52/61
2017/0081840 A1 * 3/2017 DeBuff ..... E04F 13/0833
2018/0127974 A1 * 5/2018 DeBuff ..... E04B 2/00
2018/0216340 A1 * 8/2018 DeBuff ..... E04B 2/00

* cited by examiner

800a

800b

MULTIFUNCTIONAL FLASHING DEVICE

CROSS-REFERENCE TO RELATED APPLICATIONS

This application claims the benefit of U.S. Provisional Application Ser. No. 62/783,785, filed Dec. 21, 2018, entitled "MULTIFUNCTIONAL FLASHING DEVICE," which is incorporated by reference herein in its entirety.

FIELD

The present disclosure generally relates to construction, and more specifically to lap siding installation systems.

BACKGROUND

Any discussion of the prior art throughout the specification should in no way be considered as an admission that such prior art is widely known of forms part of the common general knowledge in the field.

Flashing materials are used to protect joints or other openings, such as, for example, windows, vent pipes and so forth, in a building structure. Flashing minimizes or prevents water penetration around the joints and other openings thus protecting the interior of the building structure behind the flashing. Flashing is typically a sheet of malleable impervious material, such as metal or suitable polymer materials.

Correct installation of flashing is often regarded as being somewhat time consuming. Incorrectly installed flashing has the disadvantage of directing water into the interior of a building structure rather than away from the building structure. In addition, often methods for constructing walls or other structures covered by cladding materials are regarded as also being time consuming due to the number of steps involved to construct the wall and properly align the cladding elements.

SUMMARY

In a first aspect, a cladding system comprises a first course of lap siding comprising at least a first cladding element affixed to a building substrate by a plurality of first mechanical fasteners, a multifunctional flashing device affixed to the building substrate by at least one second mechanical fastener, and a second course of lap siding. The multifunctional flashing device comprises a substantially planar portion parallel to the first cladding element, the substantially planar portion having a top end and a bottom end opposite the top end, the at least one second mechanical fastener passing through the substantially planar portion; a cladding engagement surface extending in an exterior direction from the bottom end of the substantially planar portion such that the cladding engagement surface lies adjacent to an upper edge of the first cladding element, the cladding engagement surface having an interior end adjacent to the bottom end of the substantially planar portion and an exterior end opposite the first end; a first side member extending in a downward direction from the exterior end of the cladding engagement surface parallel to the substantially planar portion such that the first side member lies adjacent to an exterior face of the first cladding element; and a u-shaped channel defined by the first side member, a base member extending from a bottom end of the first side member, and a second side member extending upward from an exterior end of the base member. The second course of lap siding comprises a second cladding element and a third cladding element, the second cladding element and the third cladding element affixed to the building substrate by a plurality of third mechanical fasteners, the second cladding element and the third cladding element each being partially disposed within the u-shaped channel to form a cladding joint between the second cladding element and the third cladding element. The first side member further includes a breakaway section disposed between the cladding engagement surface and the bottom end of the first side member, the multifunctional flashing device being separable along the breakaway section to form a permanent flashing for the cladding joint.

In some embodiments, the multifunctional flashing device comprises formed 24-ga sheet aluminum. In some embodiments, the multifunctional flashing device comprises a polymeric material having a thickness of approximately 0.1 cm (approximately 0.04 inches). In some embodiments, the breakaway section comprises one or more notches or grooves having a depth of approximately 0.025 cm (approximately 0.01 inches). In some embodiments, the breakaway section comprises a plurality of laser cut perforations extending through the first side member. In some embodiments, the multifunctional flashing device comprises extruded polyvinyl chloride (PVC). In some embodiments, the multifunctional flashing device comprises extruded polyvinyl chloride (PVC) including an ultraviolet (UV) inhibitor.

In another aspect, an integrally formed multifunctional flashing device comprises a flashing section and a supporting section. The flashing section comprises a substantially planar portion having a first end and a second end opposite the first end, and a cladding engagement surface extending from the second end of the substantially planar portion, the cladding engagement surface having a first end adjacent to the second end of the substantially planar portion and a second end opposite the first end of the cladding engagement surface. The supporting section comprises a first side member extending from the second end of the cladding engagement surface away from the substantially planar portion, the first side member having a first end adjacent to the second end of the cladding engagement surface and a second end opposite the first end of the first side member; a base member extending from the second end of the first side member away from the cladding engagement surface; and a second side member extending from an end of the base member opposite the first side member such that the first side member, the base member, and the second side member form a channel sized and shaped to receive a cladding element therein. The first side member including a breakaway section comprising a locally thin or perforated region of the first side member disposed between the cladding engagement surface and the base member.

In some embodiments, the integrally formed multifunctional flashing device comprises 24-ga sheet aluminum. In some embodiments, the integrally formed multifunctional flashing device comprises a polymeric material having a thickness of approximately 0.1 cm (approximately 0.04 inches). In some embodiments, the breakaway section comprises two opposing notches having a depth of approximately 0.025 cm (approximately 0.01 inches). In some embodiments, the integrally formed multifunctional flashing device comprises extruded polyvinyl chloride (PVC). In some embodiments, the integrally formed multifunctional flashing device comprises extruded polyvinyl chloride (PVC) including an ultraviolet (UV) inhibitor. In some embodiments, the breakaway section is spaced between approximately 0.45 cm and approximately 0.6 cm (between approximately 0.18 inches and approximately 0.24 inches)

from the second end of the first side member. For example, the breakaway section may be spaced approximately 0.48 cm or approximately 0.56 cm (approximately 0.19 inches or approximately 0.22 inches) from the second end of the first side member in some embodiments. In some embodiments, the cladding engagement surface is disposed at an angle of between 100° and 110° relative to the substantially planar portion. In some embodiments, the second side member is disposed at an angle of between 100° and 110° relative to the base member. In some embodiments, the integrally formed multifunctional flashing device has a length parallel to the channel of between approximately 1 inch and approximately 6 inches. In some embodiments, the integrally formed multifunctional flashing device has a total height perpendicular to the channel of between approximately 3 inches and approximately 10 inches. In some embodiments, the first side member has a distance defining a predetermined overlap between adjacent courses of lap siding. In some embodiments, the integrally formed multifunctional flashing device further comprises one or more flashing fastening apertures extending through the substantially planar portion. In some embodiments, the integrally formed multifunctional flashing device further comprises one or more wind clip fastening apertures extending through the second side member.

In another aspect, a method of installing lap siding comprises obtaining an integrally formed multifunctional flashing device, the multifunctional flashing device comprising a flashing section and a supporting section connected to the flashing section by a locally thin breakaway section, the flashing section configured to serve as a flashing for a cladding joint, the supporting section configured to support one or more lap siding boards at a predetermined overlap spacing; positioning the multifunctional flashing device against a building substrate such that the flashing section abuts the building substrate and an upper edge of an installed course of lap siding; affixing the multifunctional flashing device to the building substrate by inserting one or more mechanical fasteners through the multifunctional flashing device; positioning a first cladding element within the supporting section such that the supporting section at least partially retains the first cladding element in an installation configuration; affixing the first cladding element to the building substrate by inserting one or more mechanical fasteners through the first cladding element; and separating the supporting section from the flashing section such that the flashing section is retained between the building substrate and the first cladding element.

In some embodiments, the method further comprises, prior to separating the supporting section, positioning a second cladding element within the supporting section such that the supporting section at least partially retains the second cladding element in an installation configuration; and affixing the second cladding element to the building substrate by inserting one or more mechanical fasteners through the second cladding element such that the first cladding element abuts the second cladding element to form a cladding joint. In some embodiments, the retained flashing section is concealed from view by the first cladding element and the second cladding element. In some embodiments, the method further comprises obtaining a second integrally formed multifunctional flashing device comprising a flashing section and a supporting section; positioning the second multifunctional flashing device against the building substrate such that the flashing section abuts the building substrate and the upper edge of the installed course of lap siding at a location spaced from the multifunctional flashing device by a height of the first cladding element; and affixing the second multifunctional flashing device to the building substrate, wherein the first cladding element is supported by the multifunctional flashing device and the second multifunctional flashing device in an installation position with a predetermined overlap relative to the installed course of lap siding. In some embodiments, separating the supporting section comprises applying a rotational force to the supporting section such that the multifunctional flashing device is broken at the breakaway section. In some embodiments, the method further comprises installing the separated supporting section as a wind clip at a top portion of the first cladding element or at a top portion of an abutment joint of a subsequently installed course of lap siding.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION

Figure 1C:
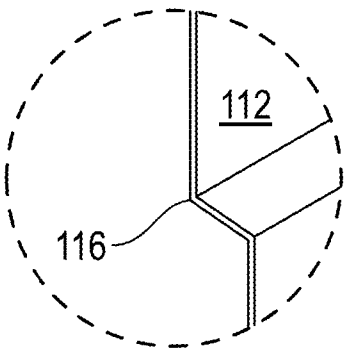
FIG. 1C is an enlarged view of detail 1C of the perspective view of the multifunctional flashing device of FIG. 1A.

Although the present disclosure is described with reference to specific examples, it will be appreciated by those skilled in the art that the present disclosure may be embodied in many other forms. The embodiments discussed herein are merely illustrative and do not limit the scope of the present disclosure.

In the description which follow, like parts may be marked throughout the specification and drawings with the same reference numerals. The drawing figures are not necessarily to scale and certain features may be shown exaggerated in scale or in somewhat generalized or schematic form in the interest of clarity and conciseness.

The present disclosure describes multifunctional flashing devices configured to function as both a permanent flashing and a temporary alignment device capable of aligning and supporting siding during installation. In some embodiments, the multifunctional flashing devices described herein may advantageously speed up the construction process when installing cladding, such as lap siding or the like, on a structural wall. The multifunctional flashing devices may additionally improve the accuracy of lap siding installation relative to conventional hand-measured installations, while also serving as a flashing to minimize water penetration at the joints between abutting ends of adjacent cladding materials.

The present disclosure describes a variety of possible advantages over existing flashing systems. The multifunctional flashing device may be advantageously configured to be installed onto a structural support or other building substrate so as to reliably provide a guide for installers for the next course of cladding materials. In a further advantage, the multifunctional flashing device may also be configured to support a course of cladding materials so that the installer can nail the course of cladding materials into position on the structural support or other building substrate. In another example advantage, the combination of a cladding support, positioning guide, and cladding joint flashing element into a single article may substantially reduce the cost, complexity, and installation time associated with the installation of lap siding or other cladding systems.

Referring now to the drawings and specifically FIGS. 1A to 3B, there are shown example embodiments of multifunctional flashing devices or sections thereof in accordance with various example embodiments. In each of the example embodiments, the multifunctional flashing devices 100, 200, 300 each generally comprise a flashing section 110, 210, 310 and a supporting section 120, 220, 320. Each multifunctional flashing device 100, 200, 300 comprises a substantially uniform profile extending along a length a of the multifunctional flashing device 100, 200, 300. In various embodiments, the length a may be, for example, between 2.54 cm and 25.4 cm (between approximately 1" and 10"), between 12.7 cm and 17.78 cm (between approximately 5" and 7"), or any other suitable range. In one example, the length a of any of the multifunctional flashing devices 100, 200, 300 is approximately 15.24 cm (approximately 6").

Figure 1B:
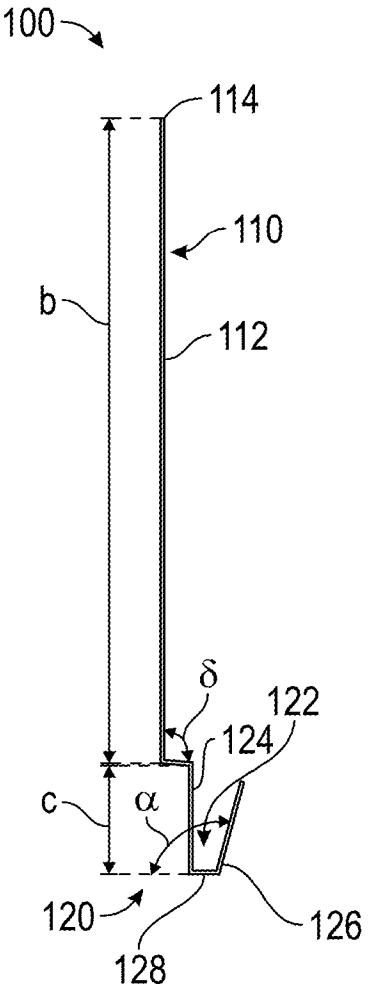
FIG. 1B is a side view of the multifunctional flashing device of FIG. 1A.
Figure 1A:
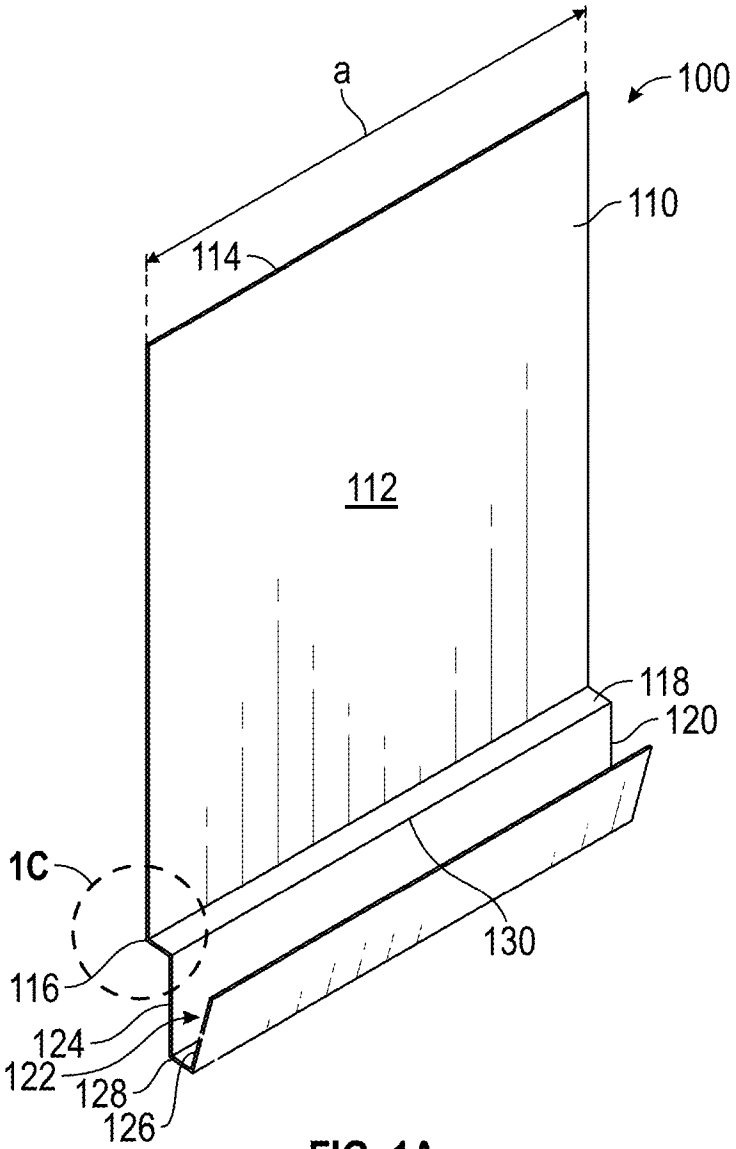
FIG. 1A is a perspective view of a multifunctional flashing device in accordance with an example embodiment.
Figure 1D:
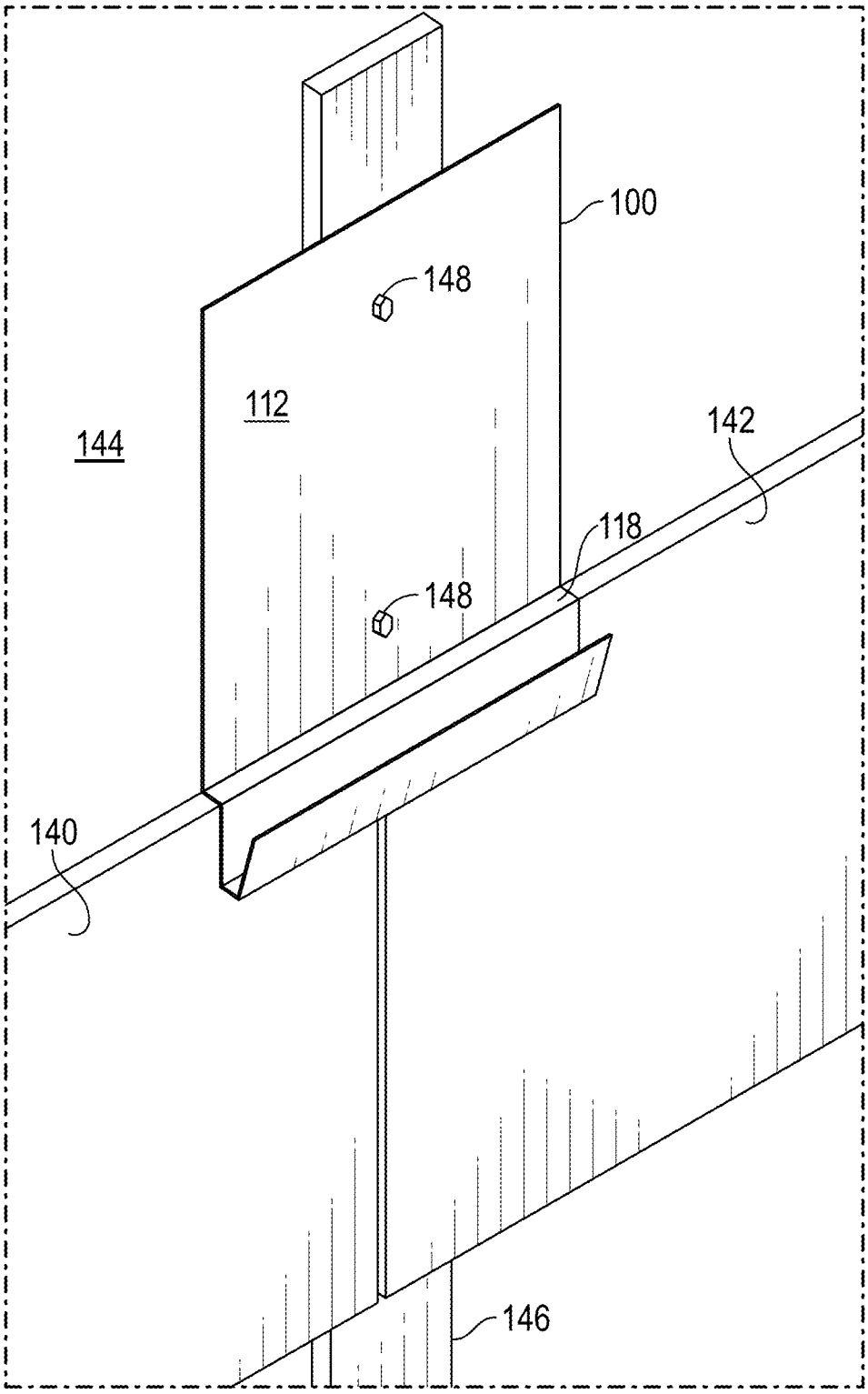
FIG. 1D is a perspective view of a partially completed lap siding installation including the multifunctional flashing device of FIG. 1A.
Figure 1E:
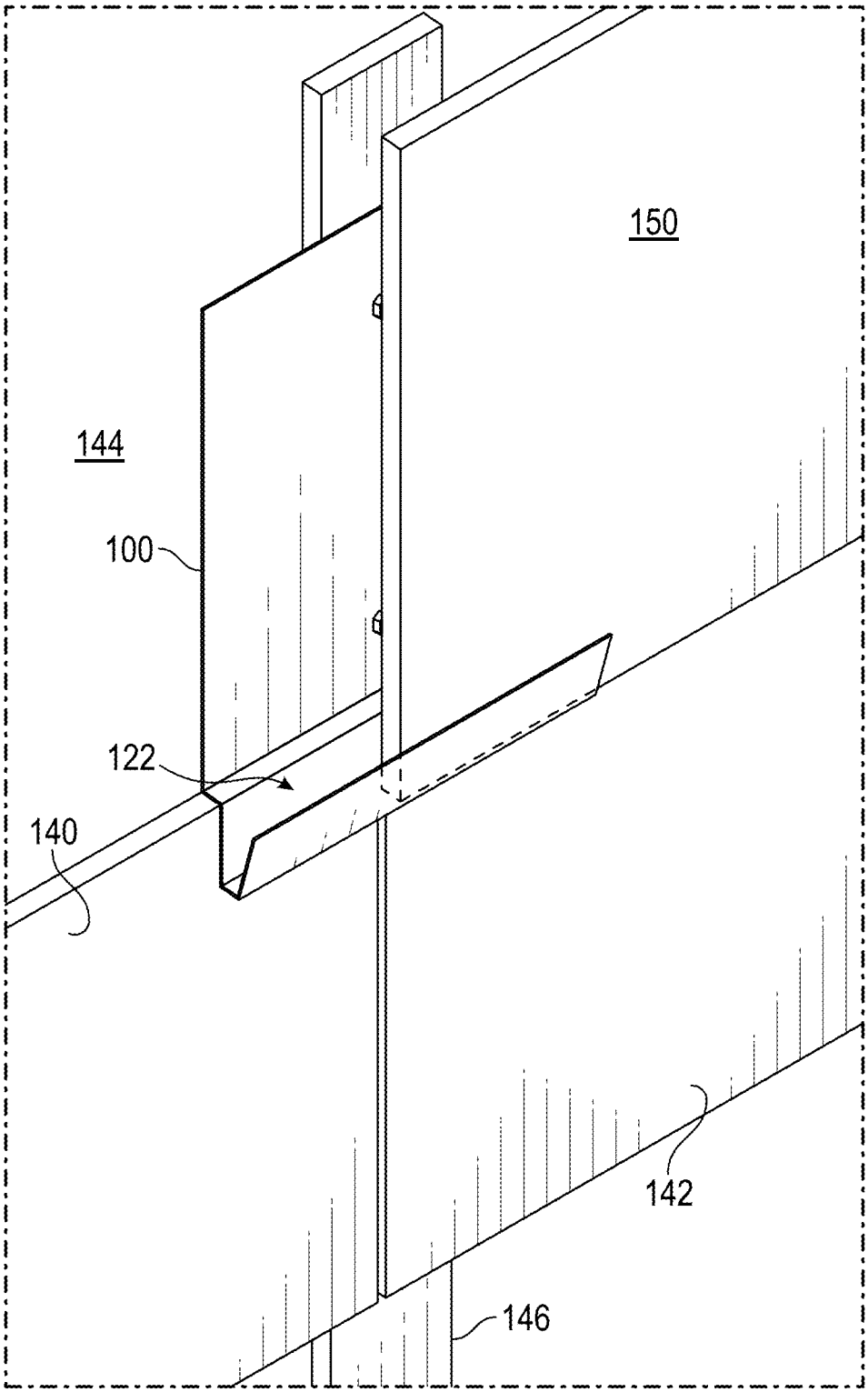
FIG. 1E is a perspective view of the lap siding installation of FIG. 1D including an additional cladding element supported by the multifunctional flashing device of FIG. 1A.

In the first example embodiment, as shown in FIGS. 1A-1F, the flashing section 110 comprises a substantially planar portion 112 which is configured to be installed on a building substrate, such as a building wall, a structural support, or a cladding support member attached to a building wall. For example, FIGS. 1D and 1E depict the multifunctional flashing device 100 affixed to a building substrate 144 by a plurality of fasteners 148 securing the substantially planar portion 112 to a batten 146. The substantially planar portion 112 comprises a first end 114 and a second end 116 disposed at opposing ends along a height b of the substantially planar portion 112. In some embodiments, the height b of the substantially planar portion 112 is between approximately 10.16 cm and 25.4 cm (between approximately 4" and 10"), between approximately 15.24 cm and 20.32 cm (between approximately 6" and 8"), or any other suitable range, from the first end 114 to the second end 116. In one embodiment, the substantially planar portion 112 extends approximately 17.8 cm (approximately 7.0"), or in another example, approximately 21.0 cm (approximately 8.25") between the first end 114 and the second end 116.

The supporting portion 120 comprises a channel 122 which is sized and shaped to accommodate a cladding member (e.g., as shown in FIG. 1E). In this first exemplary embodiment, channel 122 is formed between a first side member 124 and a second side member 126 which are spaced apart and conjoined to a base member 128 such that base member 128 is positioned intermediate the first and second side members 124 and 126. In some embodiments, the first side member 124 extends substantially orthogonally from base member 128, while the second side member 126 extends substantially at an angle $\alpha$ from base member 128. In some embodiments the angle $\alpha$ extends between a range of approximately 90° and 120° relative to the horizontal axis of base member 128, between 100° and 110°, or other suitable range. In one example, the angle $\alpha$ is approximately 105° relative to the horizontal axis of base member 128.

Multifunctional flashing device 100 further comprises a cladding engagement surface 118 positioned intermediate the substantially planar portion 112 and supporting portion 120 of flashing device 100. Referring specifically to FIG. 1A, cladding engagement surface 118 is configured such that it is intermediate to and contiguous with the second end 116 of the substantially planar portion 112 and the first side member 124 of channel 122 remote from base member 128 of the channel 122. In this first exemplary embodiment, the cladding engagement surface 118 extends at an angle $\delta$ from the second end 116 of the substantially planar portion 112. The angle $\delta$ of the cladding engagement surface 118 may be selected to facilitate and guide water runoff in use. In some embodiments the angle $\delta$ extends between a range of approximately 92° and 100° relative to the vertical axis of the substantially planar portion 112. In one example, the angle $\delta$ is approximately 95° relative to the vertical axis of the substantially planar portion 112.

The first side member 124 has a height c generally defining a depth of the channel 122. In some embodiments, the height c of the first side member 124 is selected so as to be substantially equal to a desired overlap between successive courses of cladding elements. For example, in a lap siding implementation, it may be desired to install the cladding elements with an overlap of approximately 1.27 cm (approximately 0.5"), approximately 2.54 cm (approximately 1"), approximately 3.81 cm (approximately 1.5"), approximately 5.08 cm (approximately 2"), or more, or any overlap range therebetween. In one example, the height c is approximately 3.175 cm (approximately 1.25") to achieve an overlap of approximately 1.25" between successive courses of lap siding.

In some embodiments, the flashing section 110 and supporting portion 120 are separable from each other by means of a breakaway section 130. In this first exemplary embodiment, breakaway section 130 is positioned at the junction between the cladding engagement surface 118 and the first side member 124 of the channel 122. Breakaway section 130 comprises a scored, perforated, or indented area, wherein one or more notches are cut into the material of the flashing device and extend across the length of the flashing device so that the channel 122 of the supporting portion 120 can break off from the flashing section 110 when it is rotated in an upwards direction towards the top portion of the flashing section 110. For example, in some embodiments, the breakaway section 130 comprises a perforation including a row of laser cut openings extending partially or fully through the material of the multifunctional flashing device 100. The breakaway section is described in greater detail with reference to FIGS. 4A-4C.

Referring now to FIGS. 1D and 1E, the multifunctional flashing device 100 may be affixed to a building substrate 144 adjacent to an installed course of lap siding such as cladding elements 140 and 142. The multifunctional flashing device 100 may be positioned such that the substantially planar portion 112 lies against the building substrate 144, a batten 146, or other structural support, and while the cladding engagement surface 118 rests on an upper surface of the installed cladding elements 140, 142. The multifunctional flashing device 100 may then be affixed to the building substrate 144 by one or more mechanical fasteners 148 secured through the substantially planar portion 112. With the multifunctional flashing device 100 secured to the building substrate 144, an additional cladding element 150 may be placed into the channel 122 such that the multifunctional flashing device 100 supports a first end of the additional cladding element 150. A second opposite end of the additional cladding element 150 may be supported by a second multifunctional flashing device, as described below with reference to FIGS. 5I-5L.

Figure 1F:
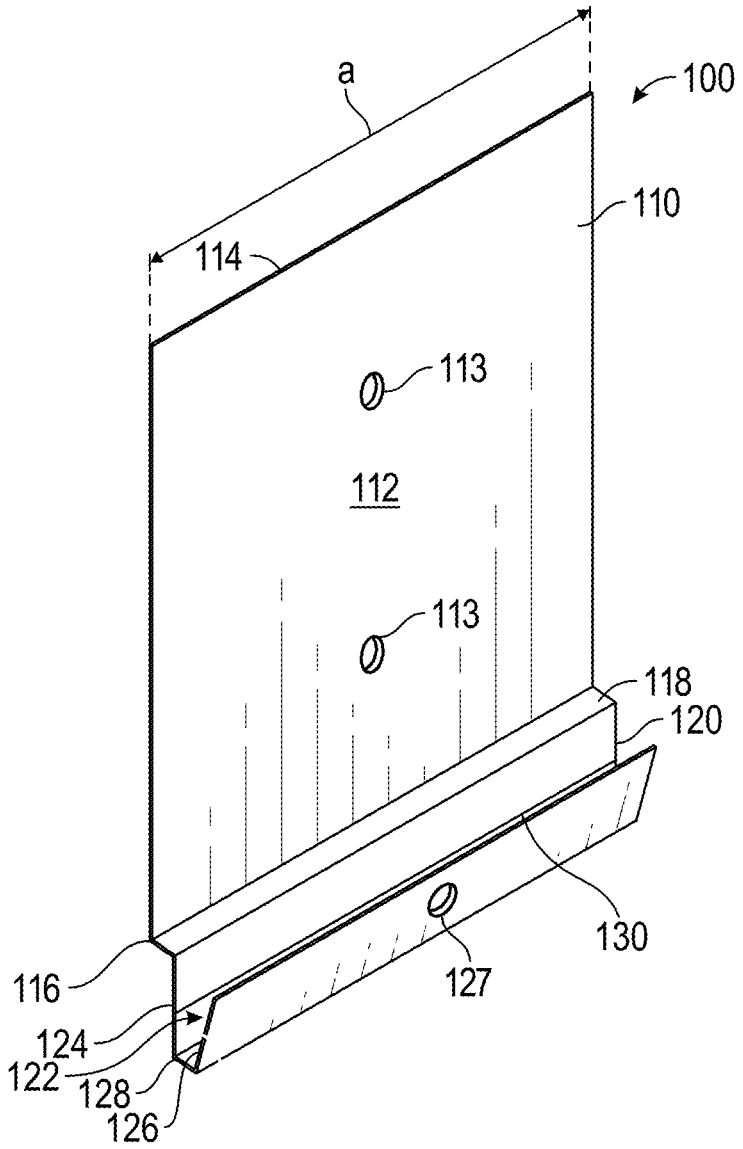
FIG. 1F is a perspective view of a further example implementation of the multifunctional flashing device of FIG. 1A.

FIG. 1F illustrates a further example multifunctional flashing device 100 similar to the multifunctional flashing device 100 of FIGS. 1A-1E, including several further optional features. In the multifunctional flashing device 100 of FIG. 1F, one or more flashing fastening apertures 113 extend through the substantially planar surface 112 of the flashing section 110 to accommodate one or more mechanical fasteners for fastening the flashing device 100 to a building substrate. Additionally, breakaway section 130 is positioned at an intermediate location along the first side member 124 of the supporting portion 120. In some embodiments, an intermediate location of the breakaway section 130 may facilitate separation of the channel 122 of the supporting portion 120.

As will be described in greater detail below with reference to FIG. 5M, in some embodiments, after the channel 122 of the supporting portion 120 is broken away from the remainder of the flashing device 100, the broken away portion may be reused as a wind clip by fastening the broken away portion or wind clip at an upper portion of the newly installed course of lap siding (e.g., at the top of the additional cladding element 150 or a subsequently installed course above the additional cladding element 150). In some embodiments, at least one wind clip fastening aperture 127 may extend through the second side member 126 and/or through the first side member 124 of the supporting portion 120 to accommodate one or more mechanical fasteners for fastening of the wind clip to cladding elements or to a building substrate. It will be understood that any one or a combination of the flashing fastening apertures 113, wind clip fastening apertures 127, and/or intermediately located breakaway section 130 may equally be incorporated within any of the other flashing devices described in the present disclosure.

Figure 1I:
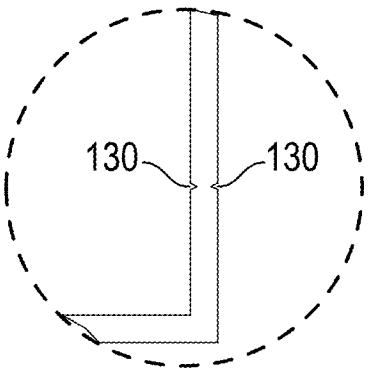
FIG. 1I is an enlarged view of detail 1I of the side view of the example implementation as shown in FIG. 1H.
Figure 1H:
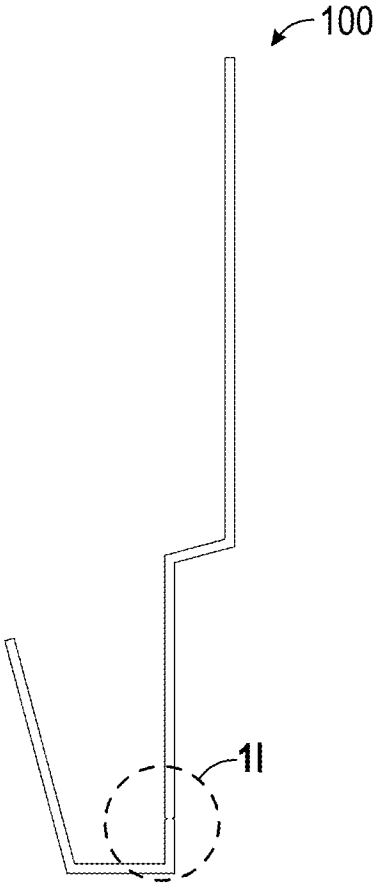
FIG. 1H is a side view of the example implementation of a multifunctional flashing device as shown in FIG. 1G.
Figure 1G:
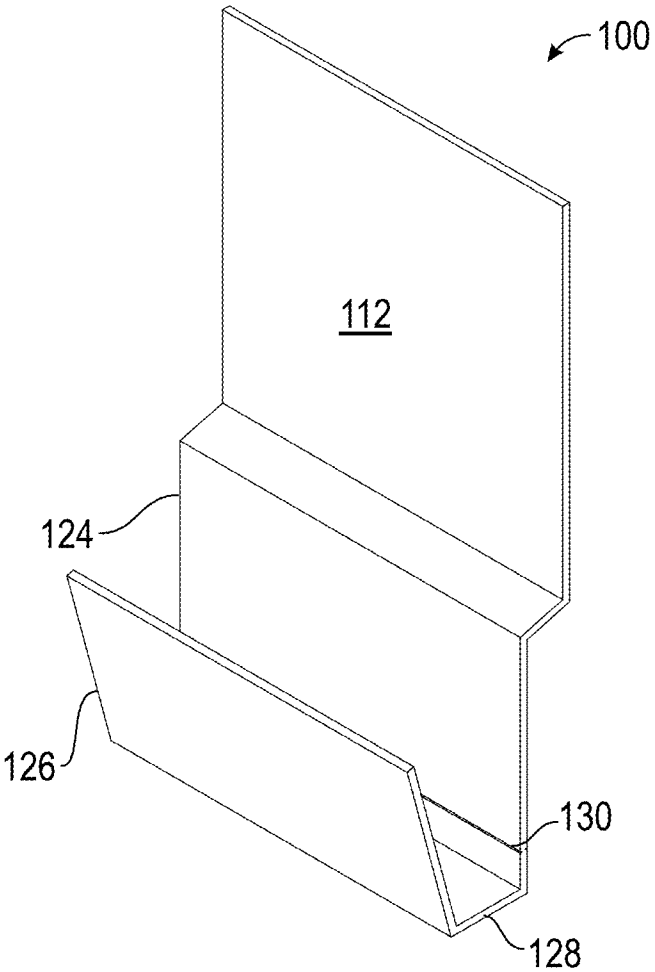
FIG. 1G is a perspective view of a further example implementation of the multifunctional flashing device of FIG. 1A.

FIGS. 1G-1I illustrate a non-limiting further example implementation of the multifunctional flashing device 100 of FIG. 1A. In some aspects, the multifunctional flashing device 100 of FIGS. 1G-1I comprises a polymeric material. In the example implementation of FIGS. 1G-1I, the multifunctional flashing device 100 has an angle δ (see FIG. 1A) of approximately 105° and an angle α (see FIG. 1A) of approximately 105°. The multifunctional flashing device 100 of FIGS. 1G-1I has a length a (see FIG. 1A) of between approximately 3.81 cm and 12.7 cm (between approximately 1.5" and 5"), such as approximately 5.08 cm (approximately 2") or approximately 7.62 cm (approximately 3"), although any suitable length a may be implemented. The multifunctional flashing device 100 of FIGS. 1G-1I has a height b (see FIG. 1A) of the substantially planar portion 112 of approximately 5.08 cm (approximately 2") and a height c of the first side member 124 of approximately 3.25 cm (approximately 1.28"). In this example implementation, the breakaway section 130 is positioned at an intermediate location along the first side member 124 spaced approximately 0.48 cm (approximately 0.1875" or 3/16") from the base member 128. The base member 128 has a width of approximately 0.95 cm (approximately 0.375") between the first side member 124 and the second side member 126, and the second side member 126 has a height of approximately 2.54 cm (approximately 1"). The breakaway section 130 comprises two opposing "V" shaped notches located on opposite sides of the first side member 124, each "V" shaped notch defining an angle of approximately 50° and having a depth of approximately 0.025 cm (approximately 0.01"), or about ¼ of the full thickness of approximately 0.10 cm (approximately 0.04"). However, it will be understood that these dimensions are merely exemplary dimensions provided for the purpose of illustrating a particular non-limiting example implementation of the present technology, and any number of variations on any of the dimensions described herein may equally be implemented, for example, based on one or more dimensions, weights, or other characteristics of cladding elements to be installed with the multifunctional flashing device 100.

In another example embodiment, the multifunctional flashing device 100 of FIGS. 1G-1I comprises a metallic material such as a sheet metal (e.g., 24-ga sheet aluminum or other suitable sheet metal). The angle δ (see FIG. 1A) is approximately 105° and the angle α (see FIG. 1A) is approximately 90° or approximately 105°. The length a (see FIG. 1A) is between approximately 3" and approximately 6"

(between approximately 7.62 cm and approximately 15.24 cm). The height b (see FIG. 1A) of the substantially planar portion 112 is approximately 7" (approximately 17.78 cm), and the height c of the first side member 124 is approximately 1.25" (approximately 3.175 cm).

Figure 2C:
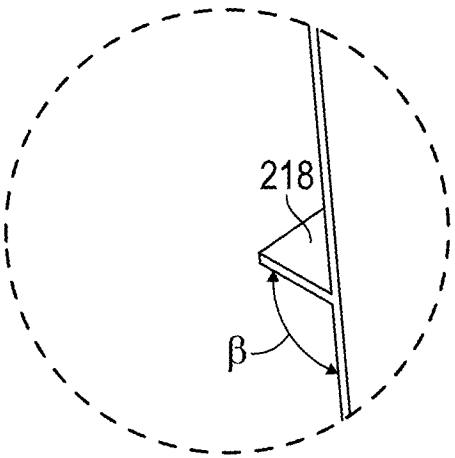
FIG. 2C is an enlarged view of detail 2C of the perspective view of the multifunctional flashing device of FIG. 2A.
Figure 2B:
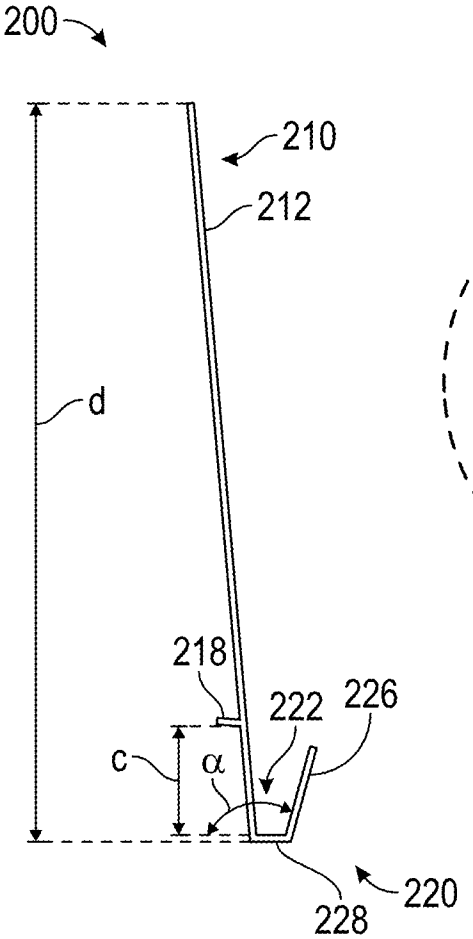
FIG. 2B is a side view of the multifunctional flashing device of FIG. 2A.
Figure 2A:
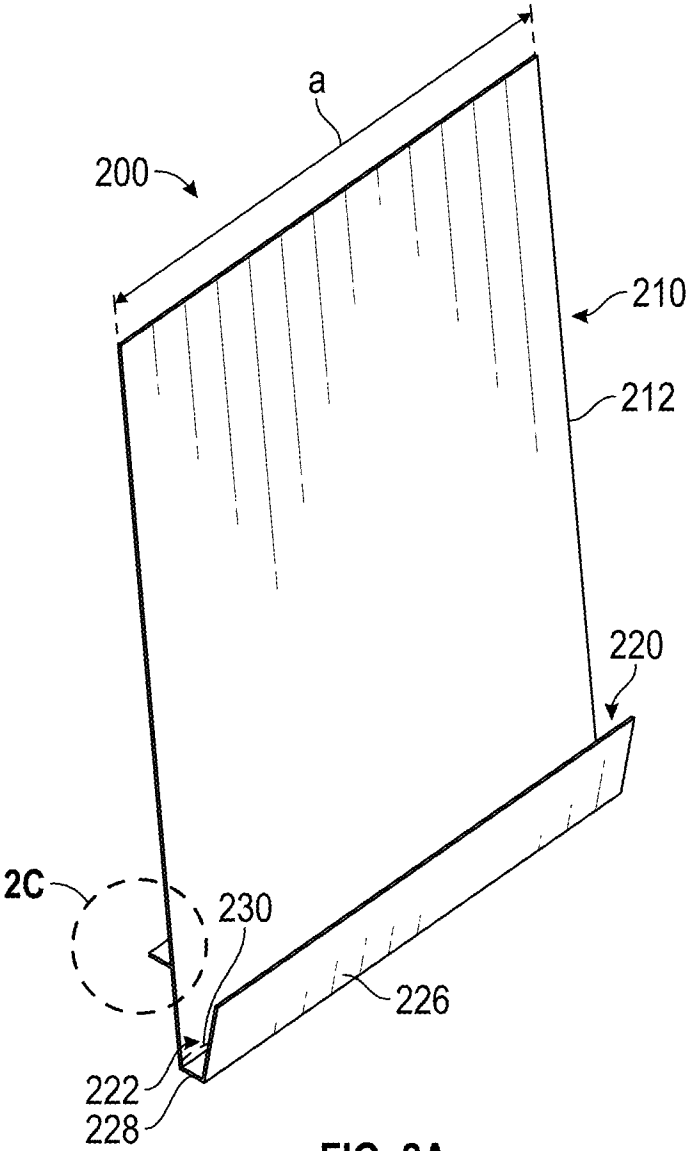
FIG. 2A is a perspective view of a multifunctional flashing device in accordance with an example embodiment.

Referring now to FIGS. 2A-2C, a second example embodiment of a multifunctional flashing device 200 similarly comprises a flashing section 210 and a supporting portion 220. In the example multifunctional flashing device 200, the substantially planar portion 212 extends beyond the cladding engagement surface 218 to define the interior side of the channel 222. Accordingly, the multifunctional flashing device 200 does not include a separate first side member to define the interior side of the channel 222. In this second exemplary embodiment, the substantially planar portion 212 defines a total height d of the multifunctional flashing device 200. In some embodiments, the height d of the substantially planar portion 212 is between approximately 12.7 cm and 33.02 cm (between approximately 5" and 13"), between approximately 17.78 cm and 25.4 cm (between approximately 7" and 10"), or any other suitable range, from the first end 114 to the second end 116. In one embodiment, the substantially planar portion 112 defines a height d of approximately 20.98 cm (approximately 8.26").

In this second exemplary embodiment, a side member 226 extends substantially at an angle α from base member 228. In some embodiments the angle α extends between a range of approximately 90° and 120° relative to the horizontal axis of base member 228, between 100° and 110°, or other suitable range. In one example, the angle α is approximately 105° relative to the horizontal axis of base member 228. The cladding engagement surface 218 extends at an angle θ from an intermediate location along the substantially planar portion 212, spaced from the lower end of the substantially planar portion 212 by an overlap height c. The angle θ of the cladding engagement surface 218 may be selected to facilitate and guide water runoff in use. In some embodiments the angle θ extends between a range of approximately 92° and 100° relative to the vertical axis of the substantially planar portion 212. In one example, the angle θ is approximately 95° relative to the vertical axis of the substantially planar portion 212. The overlap height c may be, for example, approximately 1.27 cm (approximately 0.5"), approximately 2.54 cm (approximately 1"), approximately 3.81 cm (approximately 1.5"), approximately 5.08 cm (approximately 2"), or more, or any overlap range therebetween. In one example, the height c is approximately 3.175 cm (approximately 1.25") to achieve an overlap of approximately 1.25" between successive courses of lap siding.

The multifunctional flashing device 200 further includes a breakaway section 230 configured to allow at least a portion of the supporting section 220 to be removed from the flashing section 210. Preferably, the breakaway section 230 may be located at a point along the substantially planar portion 212 between the cladding engagement surface 218 and the base member 228. Accordingly, breaking the multifunctional flashing device 200 along the breakaway section 230 allows the side member 226, the base member 228, and a lower section of the substantially planar portion 212 to be removed from the remainder of the multifunctional flashing device 200.

Figure 3B:
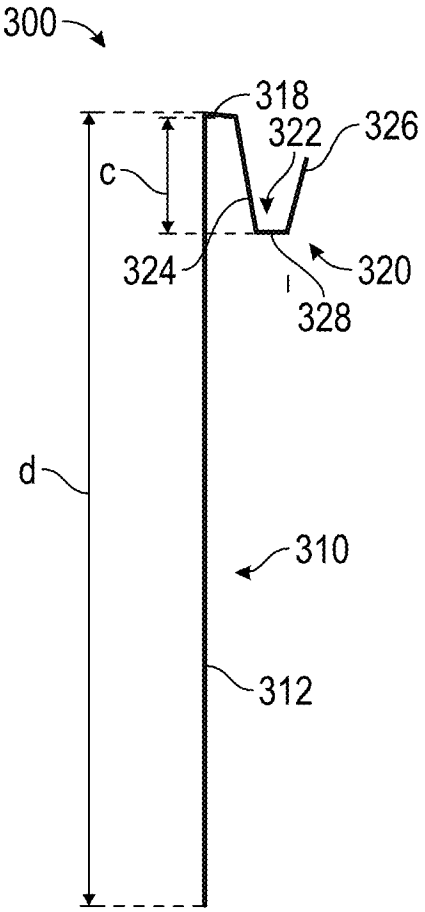
FIG. 3B is a side view of the multifunctional flashing device of FIG. 3A.
Figure 3A:
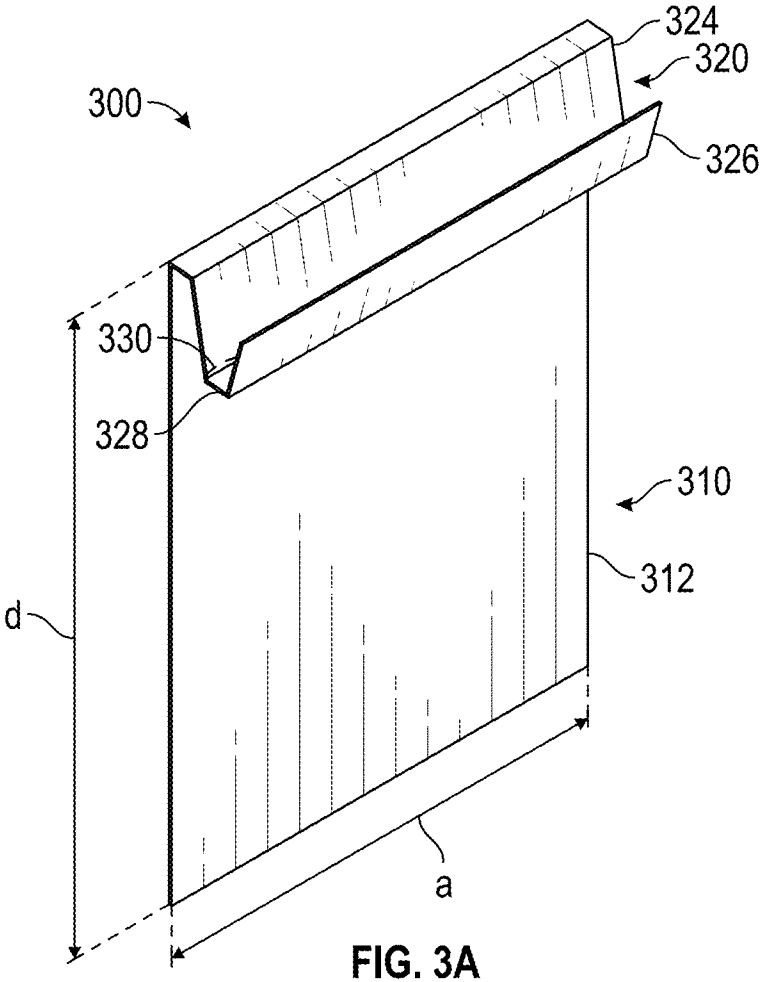
FIG. 3A is a perspective view of a multifunctional flashing device in accordance with an example embodiment.

Referring now to FIGS. 3A and 3B, a third example embodiment of a multifunctional flashing device 300 similarly comprises a flashing section 310, and a supporting section 320. The supporting portion 320 is disposed at a top portion of the multifunctional flashing device 300 and is connected to the flashing section 310 by a cladding engagement surface 318 connected to a top edge of the substantially planar portion 312. The supporting section 320 comprises a channel 322 defined by a first side member 324, a second side member 326, and a base member 328. A breakaway section 330 disposed along the first side member 324 allows the base member 328 and the second side member 326 to be removed along with a portion of the first side member 324 after a course of lap siding is installed within the channel 322.

The length of the first side member 324 may be selected so as to define a desired overlap height c. The overlap height c may be, for example, approximately 1.27 cm (approximately 0.5"), approximately 2.54 cm (approximately 1"), approximately 3.81 cm (approximately 1.5"), approximately 5.08 cm (approximately 2"), or more, or any overlap range therebetween. In one example, the height c is approximately 2.9718 cm (approximately 1.17") to achieve an overlap of approximately 1.17" between successive courses of lap siding.

Similar to the embodiment of FIGS. 2A-2C, the substantially planar portion 312 defines a total height d of the multifunctional flashing device 300. In some embodiments, the height d is between approximately 12.7 cm and 33.02 cm (between approximately 5" and 13"), between approximately 17.78 cm and 25.4 cm (between approximately 7" and 10"), or any other suitable range, from the first end 114 to the second end 116. In one embodiment, the substantially planar portion 112 defines a height d of approximately 20.32 cm (approximately 8").

Any of the multifunctional flashing devices 100, 200, 300 described herein may be integrally formed as a single piece of material, and may comprise any suitable material, such as metals, polymeric materials, composites, or other materials having sufficient dimensional stability to serve as a flashing. For example, any of the multifunctional flashing devices 100, 200, 300 may be formed from a metal such as rolled, formed, or extruded aluminum, steel, or any other suitable metals. In one example, the material is CNC formed aluminum having a thickness between 28-ga and 18-ga, such as 24-ga. In another example, the material is extruded aluminum. In other examples, the material may be a polymeric material such as vinyl (e.g., extruded ultraviolet (UV)-resistant vinyl such as a polyvinyl chloride with UV inhibitors), nylon, polyester, polyurethane, ABS, or other polymeric or plastic materials.

Figure 4A:
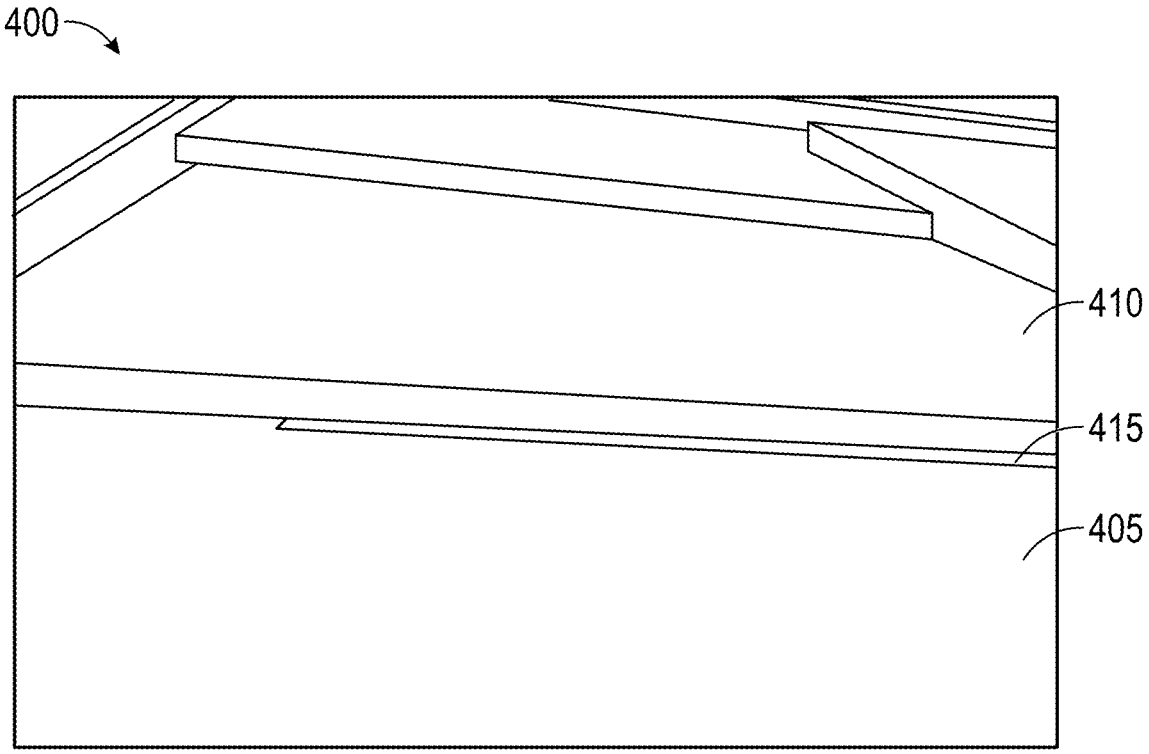
FIG. 4A is a photograph partial perspective view of a multifunctional flashing device installed between two overlapping cladding elements, in which the supporting section of the multifunctional flashing device has been removed.
Figure 4B:
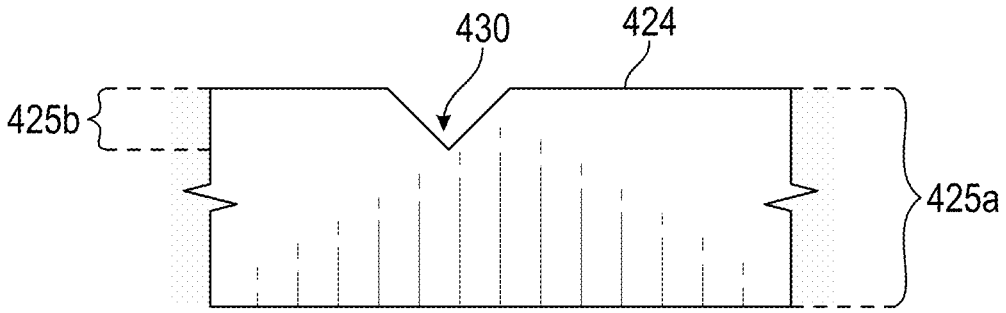
FIGS. 4B and 4C are enlarged side views of example breakaway section geometries of the multifunctional flashing devices described herein.
Figure 4C:
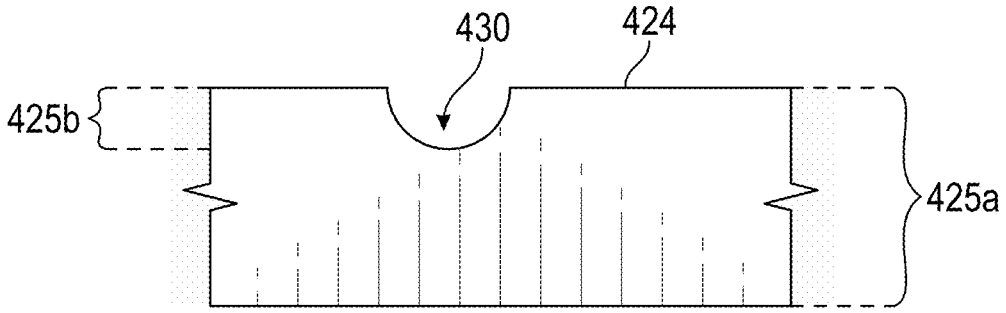

Referring now to FIGS. 4A-4C, the breakaway sections 130, 230, 330 of the multifunctional flashing devices 100, 200, 300 will be described in greater detail. In each of the example embodiments described above, the flashing section 110, 210, 310 and supporting section 120, 220 and 320 are separable from each other by means of a breakaway section 130, 230, 330. As shown in the upward-looking view of FIG. 4A, removal of the supporting section 120, 220, 320 after installation of a course of lap siding leaves a hidden flashing section 415 disposed between sequential courses 405, 410 of cladding elements. Advantageously, the remaining flashing section 415 is only visible from below and is generally hidden from exterior view.

FIGS. 4B and 4C illustrate example cross-sectional views of a breakaway section 430 in a flashing device material 424. It will be understood that the breakaway section 430 may be any of the breakaway sections 130, 230, 330 described herein. The flashing device material 424 may be any portion of the multifunctional flashing devices 100, 200, 300 described herein, such as first side members 124, 324, or substantially planar portions 112, 212, 312. In the example shown, the breakaway section 430 comprises a scored area, wherein one or a plurality of notches are cut into the material 424 of the flashing device and extend across the width of the flashing device so that the channel of the supporting portion can break off from the flashing section when it is rotated in an upwards direction towards the top portion of the flashing section. In some embodiments, the notch or plurality of notches are configured to have either a "V" shape as shown in FIG. 4B or a "U" shape as shown in FIG. 4C. In some embodiments, the breakaway section 430 may comprise a combination of both the "V" and "U" shapes. In some embodiments, the breakaway section 430 may include two opposing notches cut into opposite sides of the material 424 of the flashing, for example, as shown in the example multifunctional flashing device 100 of FIGS. 1G-1I. In some other embodiments the score is configured to any suitable form that can achieve the desired purpose.

It will be understood that the depth of the breakaway section 430 is selected to be deep enough to provide a location at which the material 424 will preferentially separate when a mechanical force is applied to remove the supporting section of the multifunctional flashing device. However, the depth of the breakaway section 430 should preferably be shallow enough that the supporting section retains sufficient strength to support a cladding element that may be placed or dropped into the channel of the multifunctional flashing device, without breaking off prematurely.

In some embodiments, the breakaway section 430 is cut into the material 424 of the flashing device to a depth 425*b* of between approximately 28% and 39% of the thickness 425*a* of the material 424 of the flashing device. In some example embodiments, the breakaway section 430 is cut into the material 424 of the flashing device to a depth 425*b* of approximately 30% of the thickness 425*a* of the material 424 of the flashing device. In one particular example, wherein the thickness 425*a* of the material 424 of the flashing device is approximately 0.511 mm (0.0201", corresponding to 24-ga sheet aluminum), the breakaway section 430 is cut into the material 424 to a depth 425*b* of approximately 0.15 mm (0.006"), or approximately 30% of the thickness 425*a*. In a further particular example, wherein the thickness 425*a* of the material 424 of the flashing device is approximately 0.483 mm (0.019", corresponding to 24-ga sheet aluminum), the breakaway section 430 is cut into the material 424 to a depth 425*b* of approximately 0.203 mm (0.008"), or approximately 42% of the thickness 425*a*.

The location of the breakaway section 430 in each of the multifunctional flashing devices described herein may be, for example, between 0 cm (0") and approximately 3.81 cm (approximately 1.5") above the base member of the channel of each of the multifunctional flashing devices 100, 200, 300. For example, in some embodiments the breakaway section 430 may be approximately 2.0574 cm (approximately 0.81") above the base member.

Referring now to FIGS. 5A-5L, lap siding installation methods using the multifunctional flashing device 200 of FIGS. 2A-2C will now be described. FIGS. 5A-5H are alternating perspective and side views sequentially illustrating, with reference to a single multifunctional flashing device 200 and a single cladding joint, an example installation method of a course of lap siding overlapping a previously installed course of lap siding. FIGS. 5I-5L are front elevation views sequentially illustrating the same method with reference to a plurality of multifunctional flashing devices 200 and cladding joints along the course. Some reference numerals corresponding to components of the multifunctional flashing device 200 in FIGS. 2A-2C are omitted from FIGS. 5A-5L for clarity. Although the methods of FIGS. 5A-5L are described with reference to the multifunctional flashing device 200, it will be understood that the methods of FIGS. 5A-5L may equally be implemented with any of the various embodiments of multifunctional flashing devices 100, 200, 300 described herein. Although fasteners for the cladding elements are not illustrated throughout FIGS. 5A-5H, it will be understood that each of the cladding elements will be affixed to the building substrate 504 and/or structural support 502 using one or more mechanical fasteners such as nails or the like.

Figure 5A:
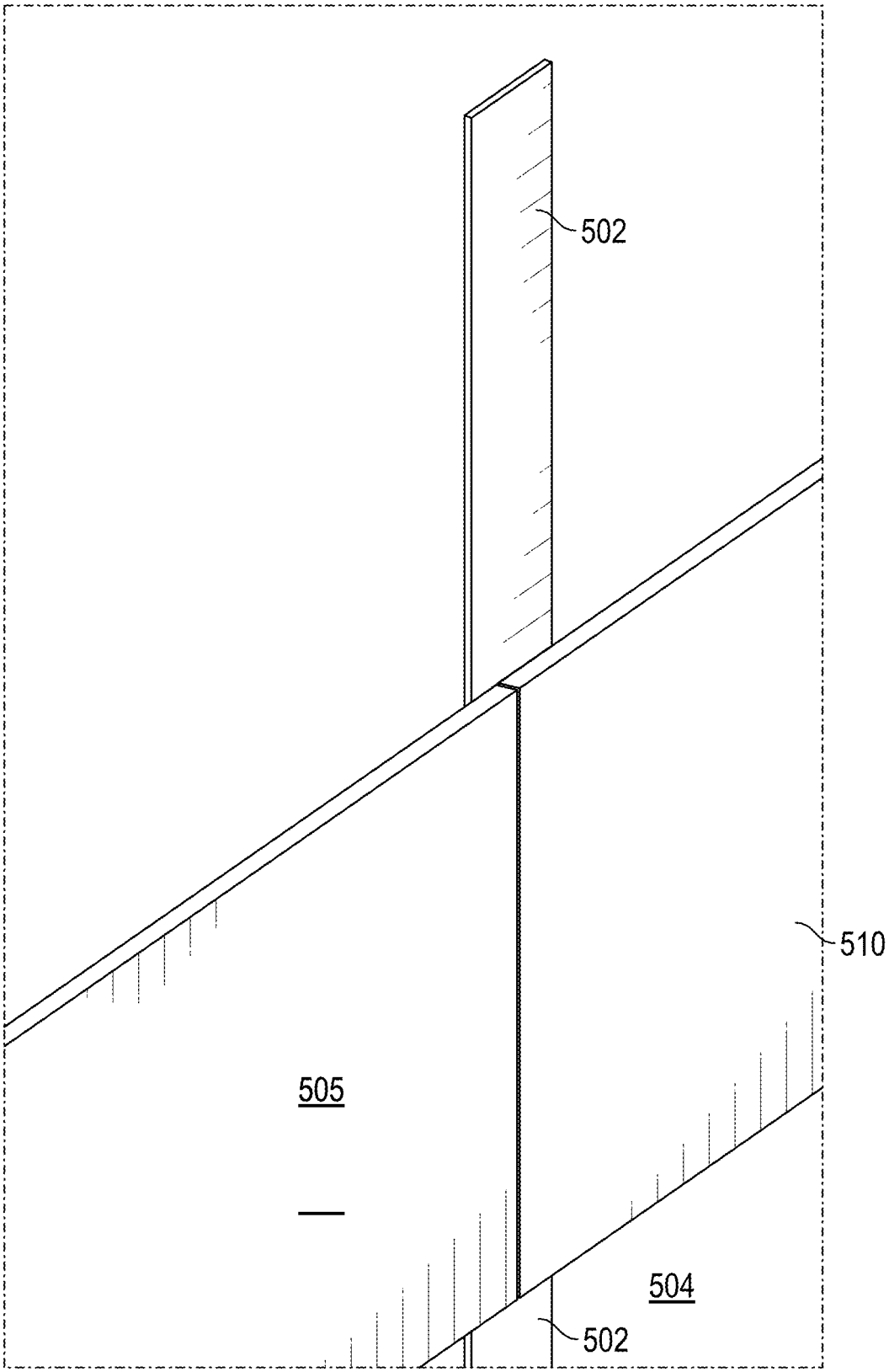
FIGS. 5A-5H are perspective and side views sequentially illustrating an example installation process of lap siding using the multifunctional flashing device of FIGS. 2A-2C.
Figure 5B:
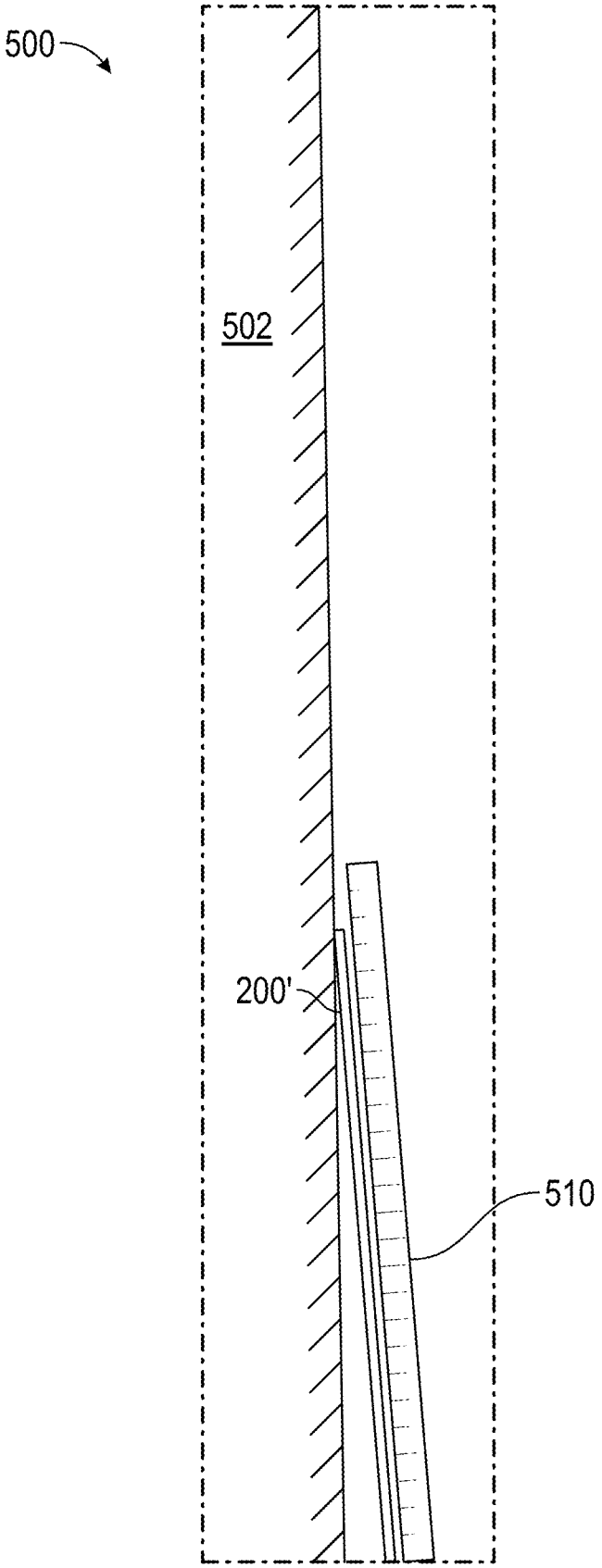

FIGS. 5A and 5B depict an initial configuration of a building substrate such as an exterior wall of a building, in the process of cladding installation. A structural support 502 (e.g., a stud, batten, furring strip, or the like) is provided on the exterior of a building substrate 504 which is being covered with a cladding such as lap siding. In the initial configuration of FIGS. 5A and 5B, a first course of lap siding, including adjacent cladding elements 505 and 510, has already been installed. The installed course includes a cladding joint between the installed cladding elements 505, 510, which is flashed by the presence of a flashing section 200'. In some embodiments, the flashing section 200' is the flashing section of a multifunctional flashing device 200 from which the supporting section 220 was removed after installation of the cladding elements 505 and 510.

Figure 5C:
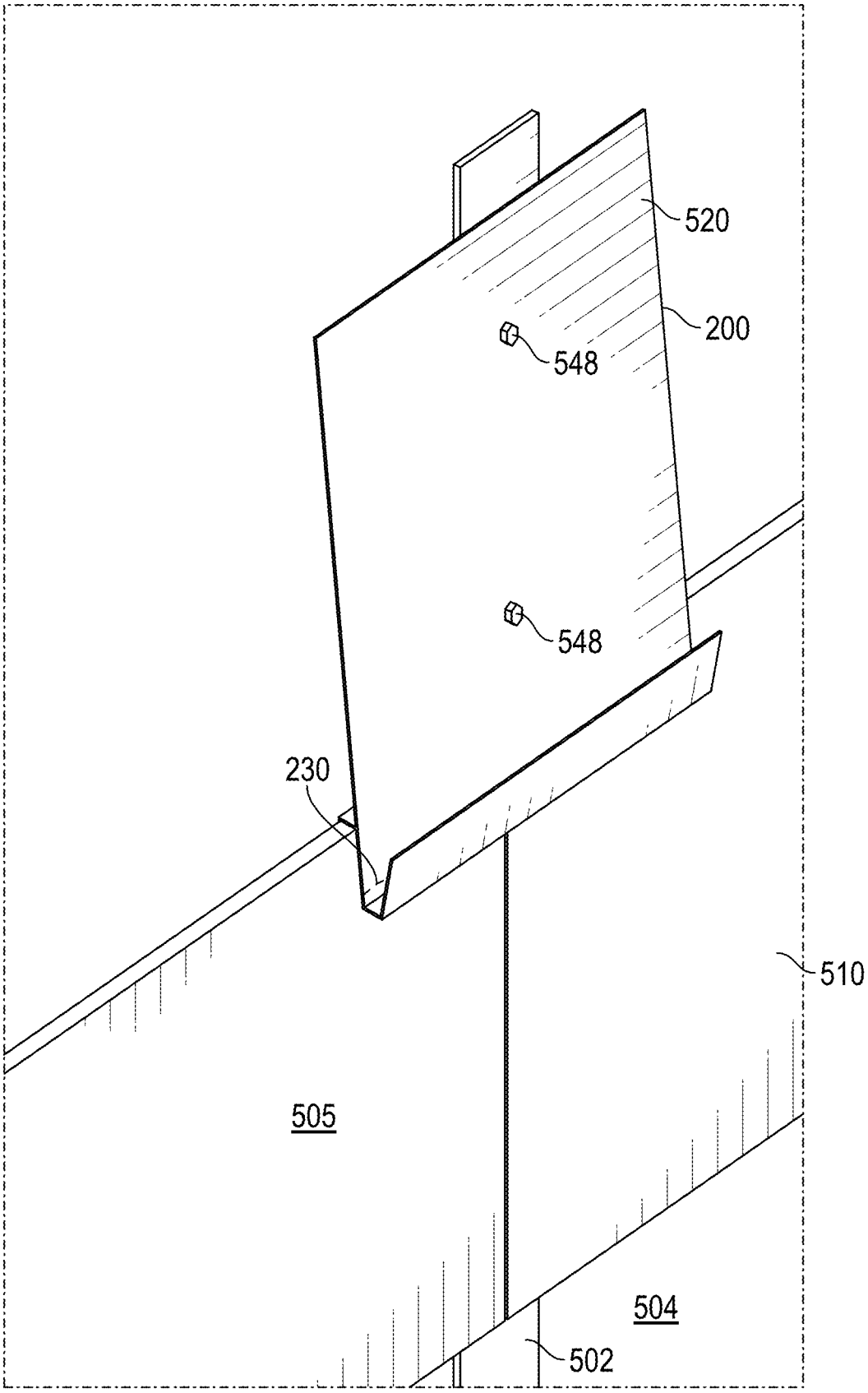
Figure 5D:
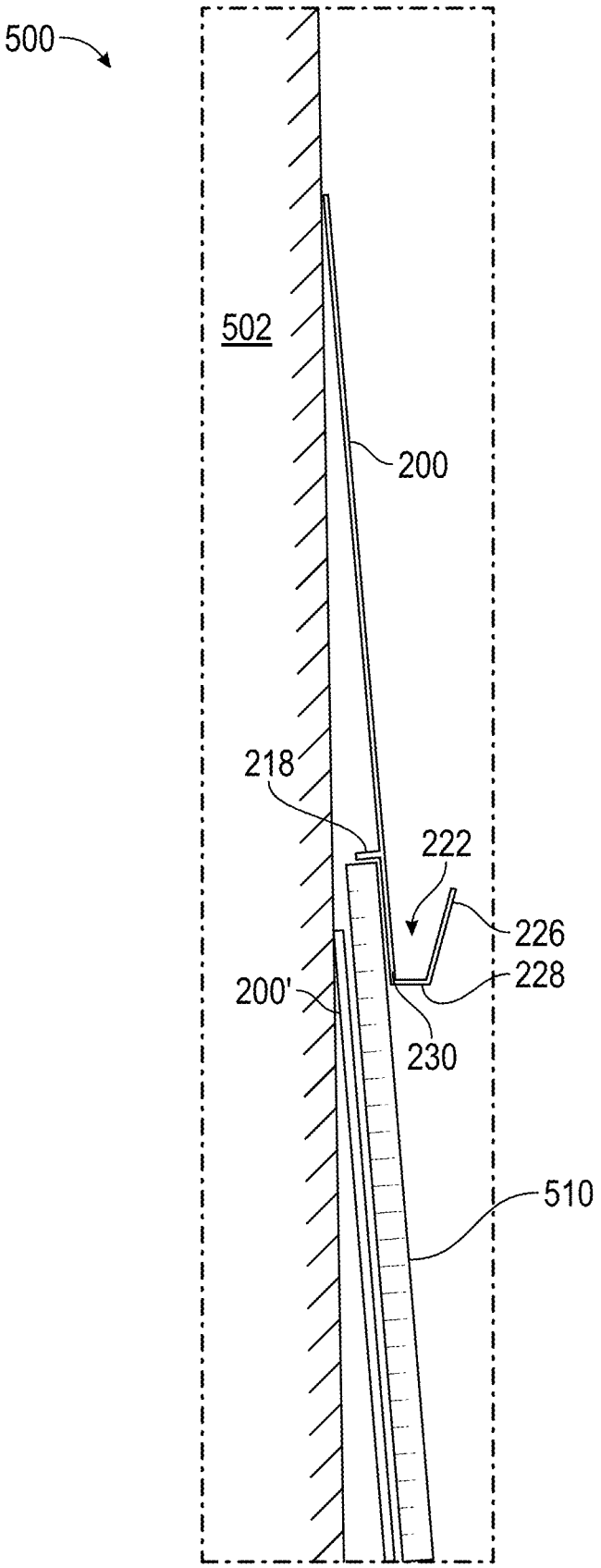

Referring now to FIGS. 5C and 5D, a multifunctional flashing device 200 is positioned against the wall at a location where a cladding joint will occur in the next course of lap siding to be installed. The multifunctional flashing device 200 may be positioned by placing a top edge of the substantially planar portion 212 of the multifunctional flashing device 200 and resting the cladding engagement surface 218 on the top of the installed cladding elements 505 and 510, such that the part of the substantially planar portion 212 below the cladding engagement surface 218 lies adjacent to an outward-facing surface of the installed cladding elements 505 and 510. The multifunctional flashing device 200 may then be secured to the building substrate 504 by inserting one or more mechanical fasteners 548 through the multifunctional flashing device 200 and into the structural support 502 and/or building substrate 504. The mechanical fasteners 548 may be any suitable type of nails, screws, bolts, or the like. In some embodiments, the mechanical fasteners 548 are nails or the like, installed such that the heads of the mechanical fasteners 548 are flush to the surface of the multifunctional flashing device 200.

Figure 5E:
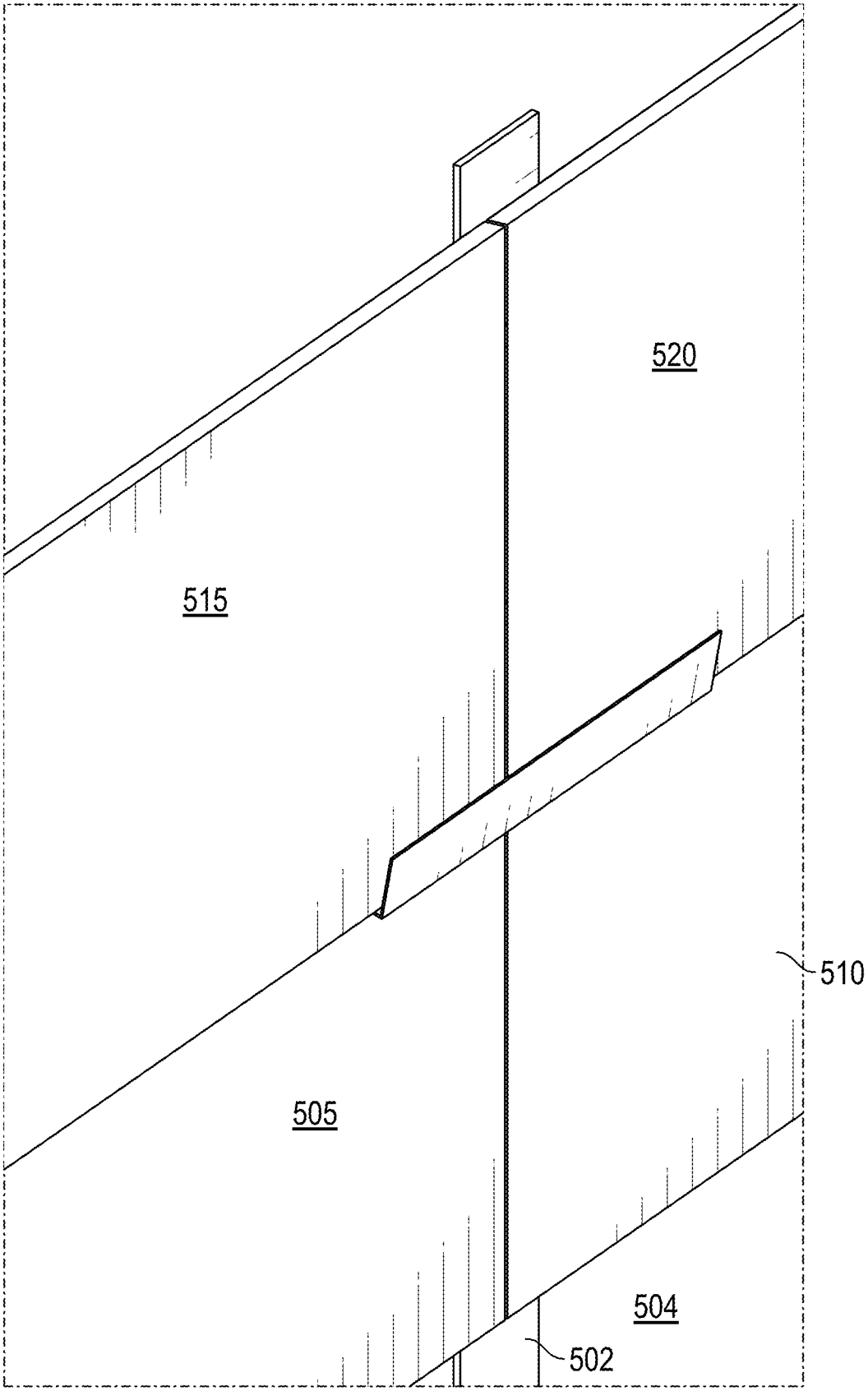
Figure 5F:
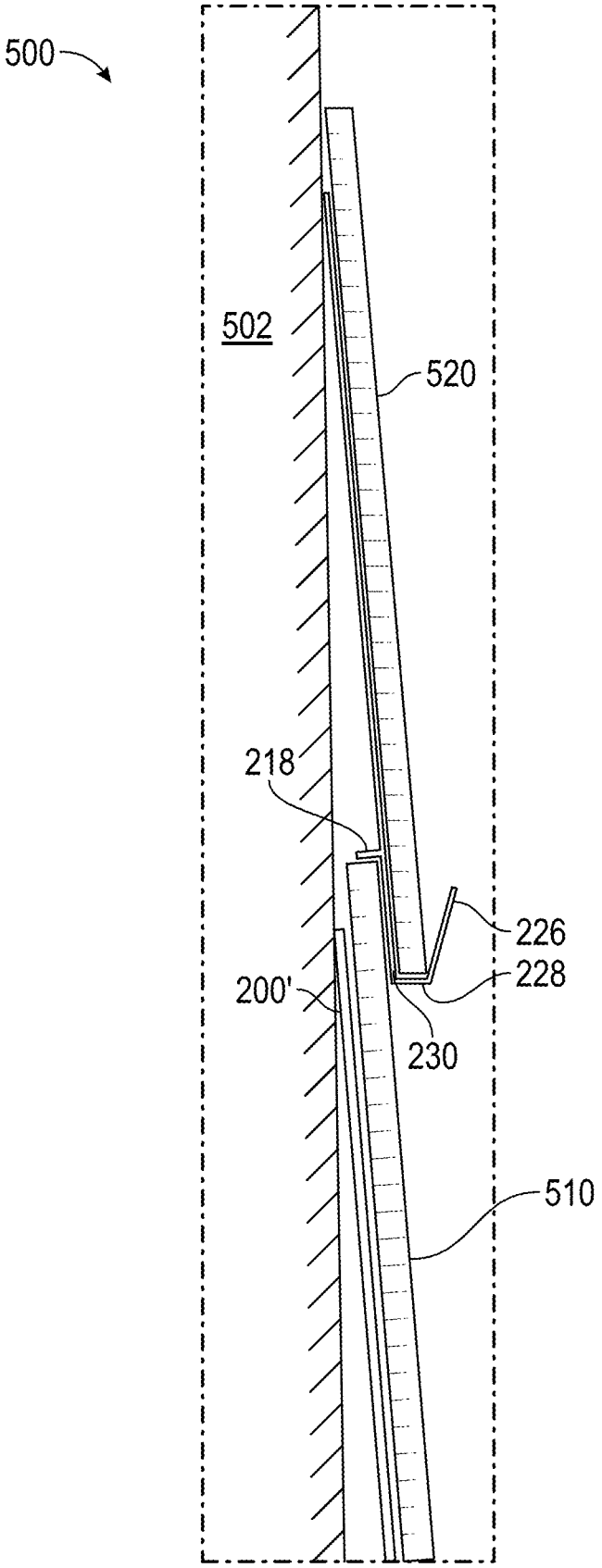

With reference to FIGS. 5E and 5F, with the multifunctional flashing device 200 secured in place, the next course of lap siding may then be assembled by placing additional cladding elements 515 and 520 into the channel 222 of the multifunctional flashing device 200 such that the flashing section 210 lies between the building substrate 504 and the cladding joint between the additional cladding elements 515, 520. In this configuration, the additional cladding elements 515 and 520 rest on the substantially planar portion 212 and the base member 228. The side member 226 retains the additional cladding elements 515 and 520 within the channel 222 such that the additional cladding elements 515 and 520 are held in a desired position for installation. The additional cladding elements 515 and 520 may then be fixed to the building substrate 504 and/or the structural support 502 by one or more mechanical fasteners. As shown in FIGS. 5E and 5F, the base member 228 and side member 226 of the channel 222 remain visible.

Figure 5G:
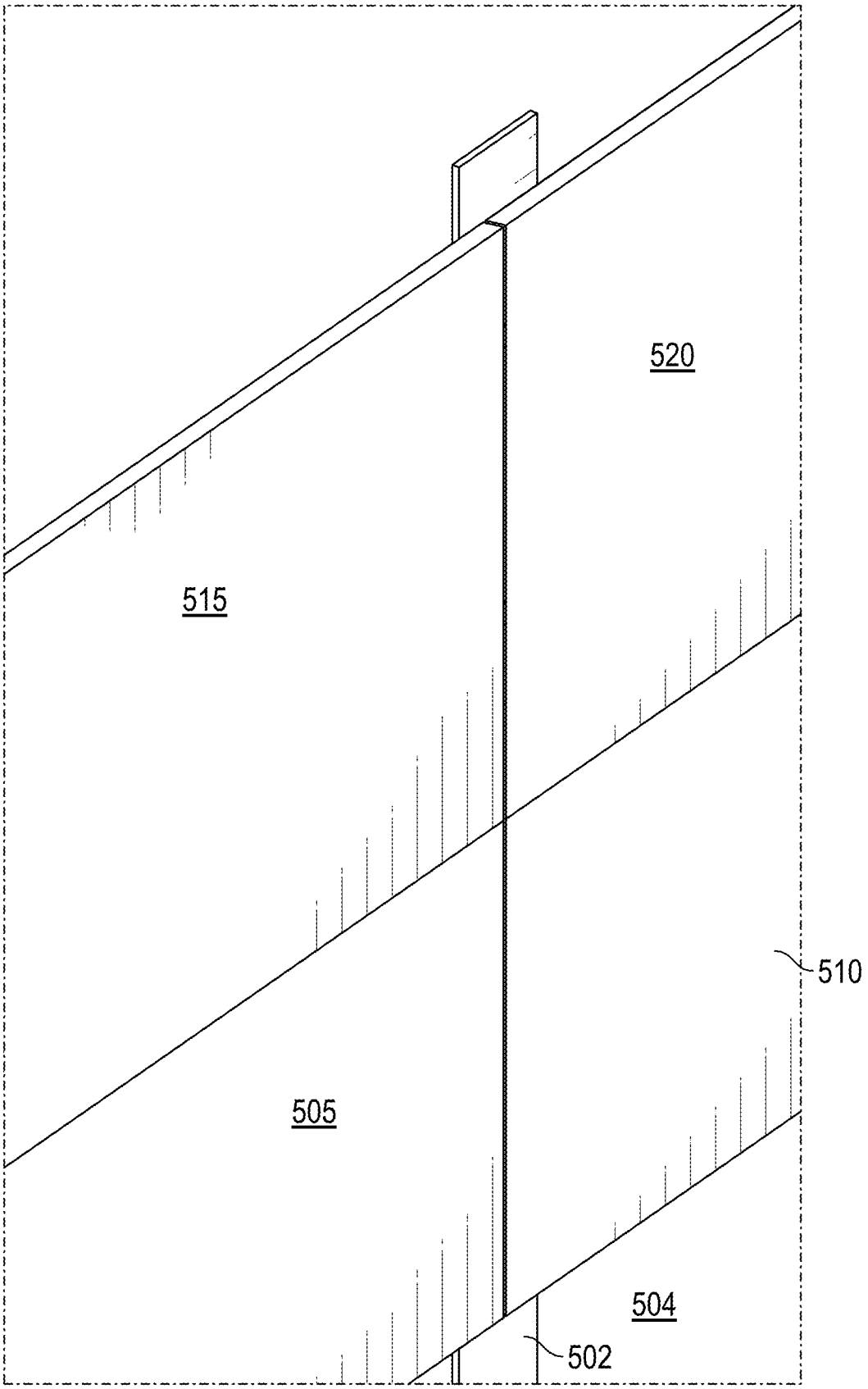
Figure 5H:
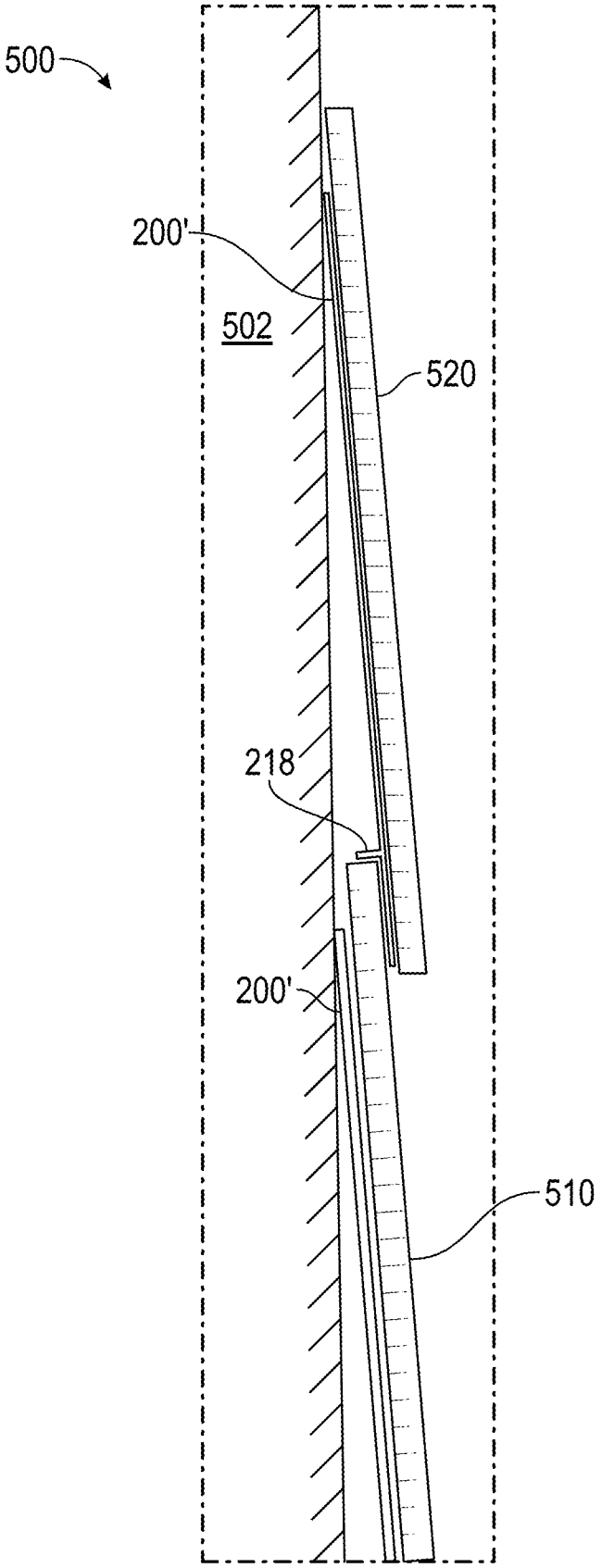

Referring now to FIGS. 5G and 5H, the base member 228 and the side member 226 of the multifunctional flashing device 200, as well as a bottom portion of the substantially planar portion 212, may be removed by bending the supporting section 210 upward, downward, forward (e.g. toward the wall) and/or outward (e.g., away from the wall) such that the multifunctional flashing device 200 breaks along the breakaway section 230 (FIG. 5F). Accordingly, the remaining flashing portion 200' of the multifunctional flashing device 200 is substantially hidden from view, and is not visible from a side or top perspective, as shown in FIG. 5G. In the configuration of FIGS. 5G and 5H, the installation of the additional course of lap siding is completed, and additional courses may then be installed above and overlapping cladding elements 515 and 520, using the same method described above with reference to FIGS. 5A-5H.

Figure 5I:
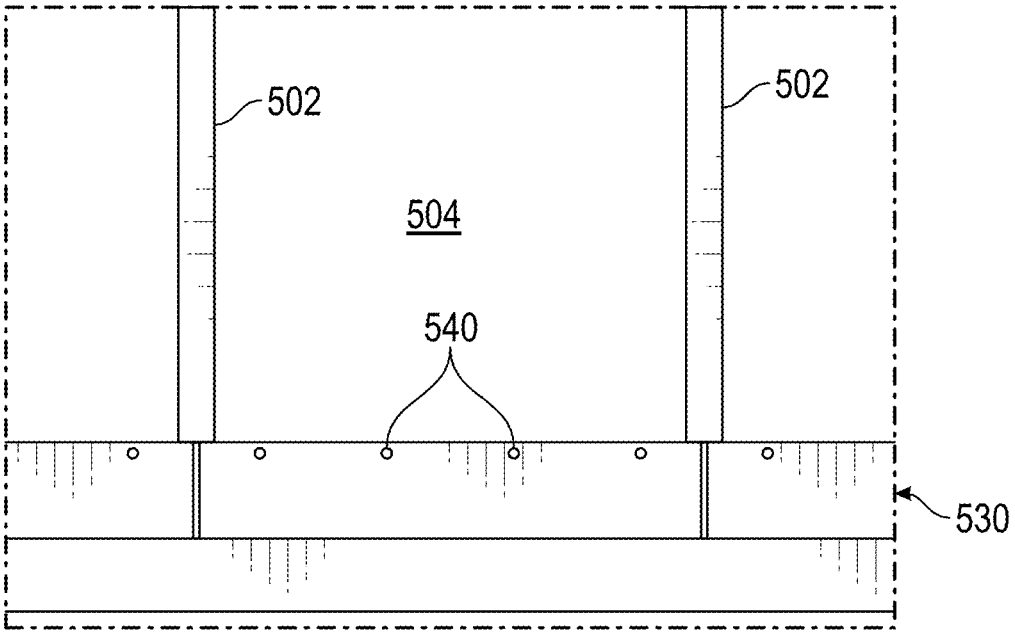
FIGS. 5I-5M are front elevation views sequentially illustrating an example installation process of lap siding using a plurality of multifunctional flashing devices of FIGS. 2A-2C.

FIGS. 5I-5M are front elevation views illustrating the method of FIGS. 5A-5H as applied to a larger section of the building substrate 504. FIG. 5I depicts a configuration corresponding to the initial configuration of FIGS. 5A and 5B, in which a first course 530 of lap siding has been installed onto the building substrate 504 and optional structural supports 502. The elements of the first course 530 are secured to the building substrate 504 by mechanical fasteners 540.

Figure 5J:
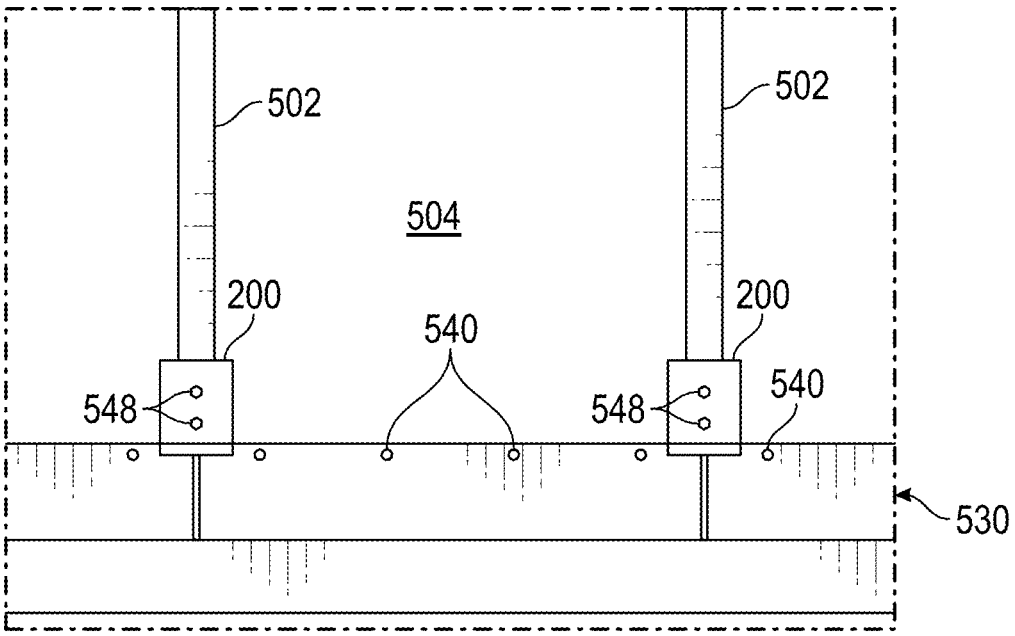

As shown in FIG. 5J, a plurality of multifunctional flashing devices 200 may be installed at locations corresponding to the cladding joints of an additional course of lap siding to be installed. Similar to the configuration of FIGS. 5C and 5D, the multifunctional flashing devices 200 may be positioned to rest on the elements of the first course 530 and secured to the structural supports 502 and/or the building substrate 504 by mechanical fasteners 548.

Figure 5K:
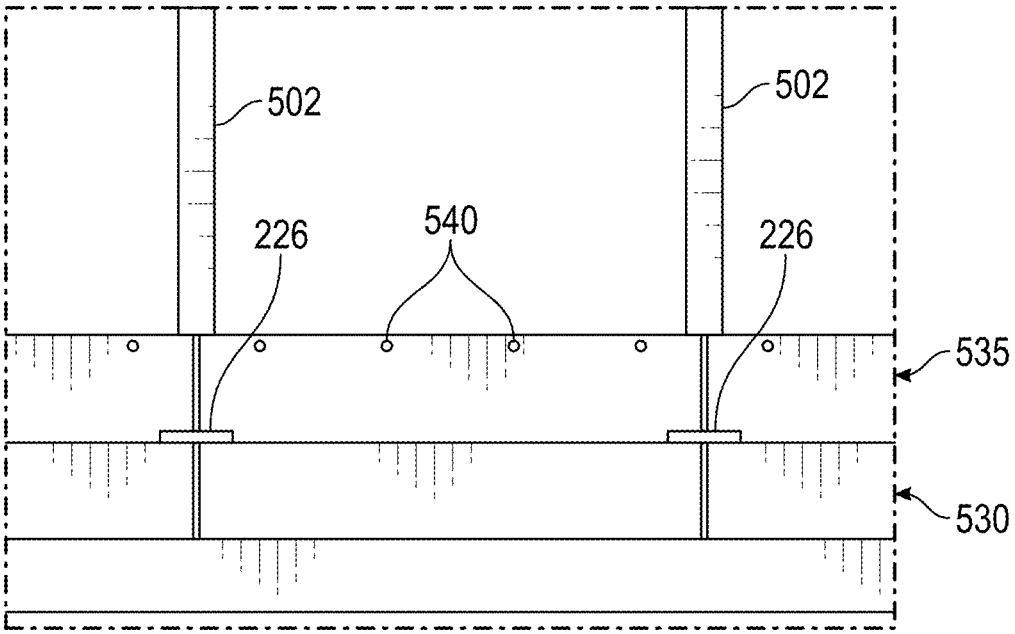

Continuing with reference to FIG. 5K, additional cladding elements may be placed into the channels 222 of the multifunctional flashing devices 200 to form an additional course 535 of lap siding. Preferably, when an additional course 535 of lap siding is installed, a multifunctional flashing device 200 is provided at each end of each cladding element such that each cladding element is stably supported in at least two locations. The multifunctional flashing devices 200 ensure that the additional course 535 is placed substantially parallel to the first course 530, and at the desired overlap. In some embodiments, the desired overlap may further cause the additional course of lap siding to conceal the mechanical fasteners 540 of the first course 530. The cladding elements of the additional course 535 of lap siding may then be secured to the building substrate 504 by additional mechanical fasteners 540 (e.g., nails or the like).

Figure 5L:
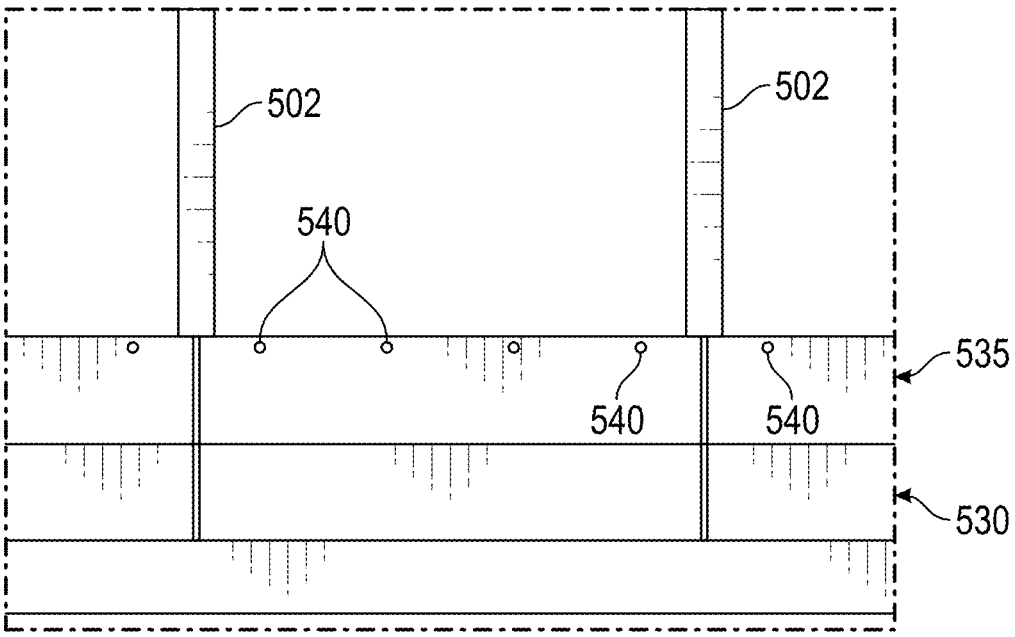

After the second course 535 of lap siding is secured to the building substrate 504, the supporting section 210 of each of the multifunctional flashing devices 200, including the visible channel side members 226, may then be manually removed by bending upward and/or downward to cause a separation at the breakaway sections 230. Accordingly, as shown in FIG. 5L, the additional course 535 of lap siding is installed accurately and efficiently with suitable flashing behind each cladding joint.

Figure 5M:
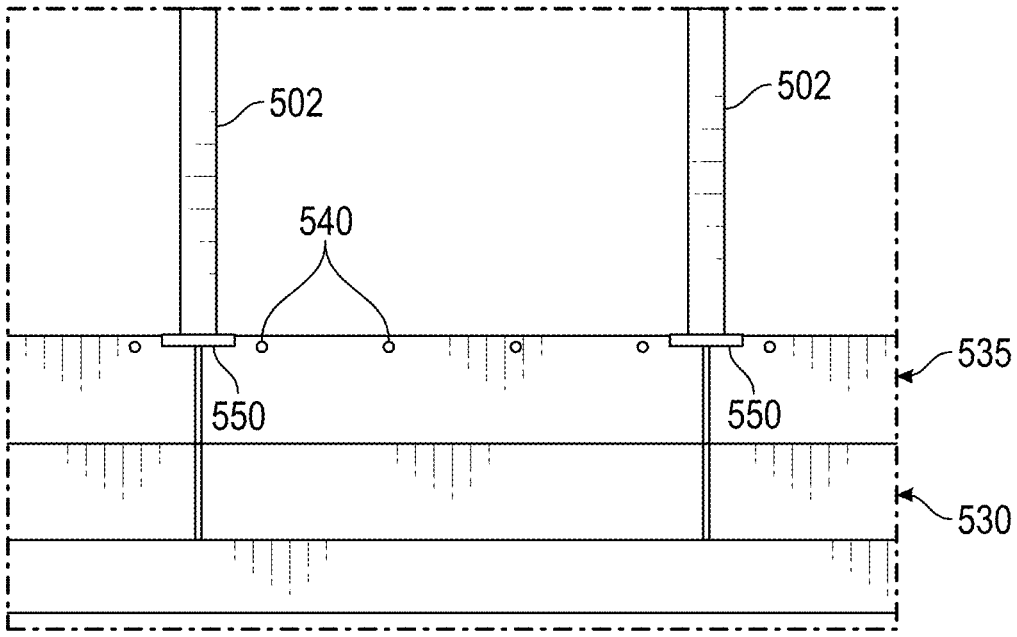

Referring now to FIG. 5M, one or more wind clips 550 may be installed at an upper end of the additional course 535 of lap siding to further prevent water from passing through the abutment joint and/or to provide additional wind load resistance to the installed lap siding. In some embodiments, the supporting sections 210 of the multifunctional flashing devices 200 may optionally be inverted and utilized as the wind clips 550 at the top of the additional course 535 of lap siding. In some example implementation, the supporting sections 210 may installed as wind clips 550 after the cladding elements of the additional course 535 of lap siding are secured to the building substrate 504, by sliding the first side member 224 or second side member 226 downward between the structural supports 502 or the building substrate 504 and the additional course 535 of lap siding after the supporting sections 210 have been removed from the multifunctional flashing devices 200. In another example implementation, the supporting sections 210 from a previously installed course (e.g., from multifunctional flashing devices 200 used in installing the first course 530) may be placed before the cladding elements of the additional course 535 of lap siding are secured to the building substrate 504. In either example implementation, the wind clips 550 may be held in place by the additional course 535 of lap siding and/or may be fastened to the building substrate 504 or structural supports 502 by one or more mechanical fasteners, such as through wind clip fastening apertures 127 as shown in FIG. 1F. It will be understood that the optional wind clip features described herein may be implemented with any of the multifunctional cladding devices 100, 200, 300, and/or with any variants thereof, as disclosed herein.

The installation methods of FIGS. 5A-5M may provide a number of advantages relative to conventional lap siding installation methods. For example, a single installer using the multifunctional flashing devices 200 may be able to install one or more courses of lap siding without requiring a second installer to assist with positioning and/or holding each cladding element while it is secured to the building substrate. In addition, positioning each cladding element using a plurality of substantially identical flashing devices may allow installers to achieve better accuracy than previously possible even with a plurality of installers.

FURTHER EXAMPLE EMBODIMENT

Figure 7:
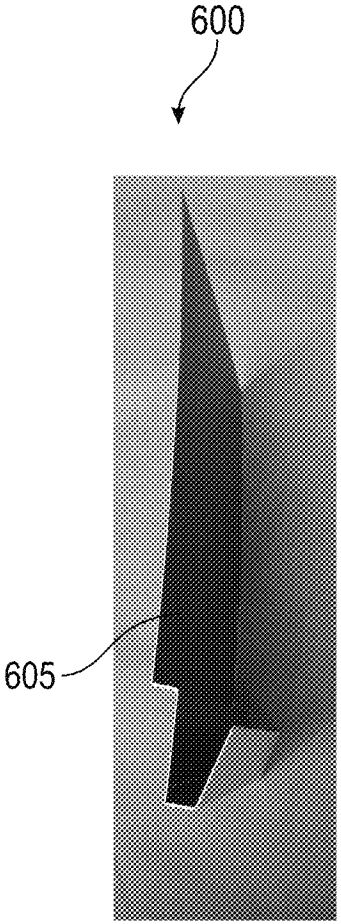
FIGS. 6 and 7 illustrate a further example embodiment of a flashing member in accordance with the present technology.
Figure 6:
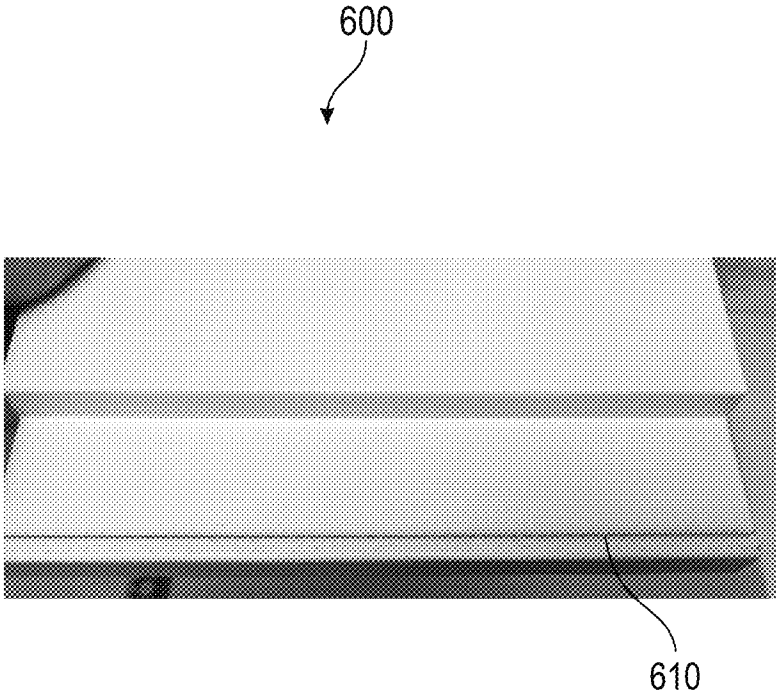

FIGS. 6 and 7 are photographs illustrating a further example implementation of a multifunctional flashing device 600 which may in some embodiments be consistent with the embodiments described with reference to FIGS. 1A-1I. In the example of FIGS. 6 and 7, the multifunctional flashing device comprises a sheet aluminum. The multifunctional flashing device may have a coating 605 such as a black coating or other dark coating on an outward facing side in some embodiments, so as to reduce any negative aesthetic effect if a portion of the multifunctional flashing device is visible from the exterior after installation. The multifunctional flashing device of FIGS. 6 and 7 further illustrates the perforation embodiment of the breakaway section discussed above. In the example of FIGS. 6 and 7, the breakaway section comprises a row of laser cut perforations 610 extending partially or fully through the thickness of the multifunctional flashing device at an intermediate location along the first side member, facilitating bending and breaking of the supporting section from the flashing section.

Results of Analysis and Testing

Various embodiments of the multifunctional flashing devices described herein were evaluated using finite element analysis, wind load testing, water ingress testing, exposure accuracy testing, breakaway section performance testing, and installation efficiency testing. The results of such analysis and testing are provided below.

Finite Element Analysis

Finite element analysis (FEA) was used to evaluate the effects of the length a and breakaway section depth of the multifunctional flashing devices described herein. The force acting on the flashing devices was considered in three conditions: at an angle of 180 degrees, 100 degrees, and 90 degrees relative to vertical. Because installers may sometimes drop cladding elements into the channels rather than placing the cladding elements gently, the force created by dropping a cladding element was considered. Dropping a cladding element into a flashing device channel creates a downward dynamic load which may be approximately 3 times more severe than the corresponding static load. For example, a flashing device capable of supporting 3,306 pounds of static force may only be able to support the corresponding dynamic force of a 1,102-pound cladding element. Similarly, a flashing device capable of supporting 232 pounds of static force may only be able to support the corresponding dynamic force of an 80-pound cladding element. However, these flashing devices are still able to support the dynamic force corresponding to common cladding elements having weights of up to 80 pounds, and any cladding element having a lower weight will be adequately supported. In some embodiments, certain non-limiting examples of cladding elements that would be adequately supported by these flashing devices would include a cladding element having a length of 4.2 m (165.354 in) and a weight per lineal meter of 3.8 kg (8.38 lb) or 3.2 kg (7.05 lb). It will be understood that the weight supported by each cladding element may vary based on the amount of material cut away when creating a breakaway section.

FEA was performed on a model of the multifunctional flashing device 200 of FIGS. 2A-2C in 25-ga sheet aluminum for a variety of lengths a and breakaway section 230 depths. The results of the analysis are provided in Table 1 below.

TABLE 1

Results of finite element analysis (FEA) of example flashing devices

| ID | | Parameters (Flashing Width) | | | |
|---|---|---|---|---|---|
| | | 6" | 4" | 3" | 1" |
| 1 | Aluminum type (25-ga) | 3105 | 3105 | 3105 | 3105 |
| 2 | Min tensile strength (TS) | 29000 psi | 29000 psi | 29000 psi | 29000 psi |
| 3 | Cross Section Thickness | 0.019" | 0.019" | 0.019" | 0.019" |
| 4 | Width | 6" | 4" | 3" | 1" |
| 5 | Cross Section Area | 0.114 sq. inch | 0.076 sq. inch | 0.057 sq. inch | 0.019 sq. inch |
| 6 | Weight supported (TS × Cross Section Area) | 3306 lbs. | 2204 lbs. | 1653 lbs. | 551 lbs. |
| 7 | Cross Section thickness after cutaway | 0.008" | 0.008" | 0.008" | 0.008" |
| 8 | Cross Section Area after cutaway | 0.048 sq. inch | 0.032 sq. inch | 0.024 sq. inch | 0.008 sq. inch |
| 9 | Weight Supported lbs. with cutaway (TS × Cross Section Area) | 1392 lbs. | 928 lbs. | 696 lbs. | 232 lbs. |

In a further example, the same analysis can be performed on a similar device having a laser cut perforation at the breakaway section 230, rather than a cutaway groove of reduced thickness. In the example embodiment corresponding to Table 2, the laser cut perforations removed approximately one-half the total effective width of the multifunctional flashing device (e.g., the sections of remaining aluminium between the perforations each had a width approximately equal to the widths of the perforations or openings through the aluminium created by the laser cut). There was no reduction in thickness of the multifunctional flashing device material along the breakaway section. The results of the analysis for such a laser perforated embodiment are provided in Table 2 below.

TABLE 2

Results of finite element analysis (FEA) of example flashing devices

| ID | | Parameters (Flashing Width) | | | |
|---|---|---|---|---|---|
| | | 6" | 4" | 3" | 1" |
| 1 | Aluminum type (25-ga) | 3105 | 3105 | 3105 | 3105 |
| 2 | Min tensile strength (TS) | 29000 psi | 29000 psi | 29000 psi | 29000 psi |
| 3 | Cross Section Thickness | 0.019" | 0.019" | 0.019" | 0.019" |
| 4 | Width | 6" | 4" | 3" | 1" |
| 5 | Cross Section Area | 0.114 sq. inch | 0.076 sq. inch | 0.057 sq. inch | 0.019 sq. inch |
| 6 | Weight supported (TS × Cross Section Area) | 3306 lbs. | 2204 lbs. | 1653 lbs. | 551 lbs. |
| 7 | Effective Width after perforation | 3" | 2" | 1.5" | 0.5" |
| 8 | Cross Section Area after perforation | 0.057 sq. inch | 0.038 sq. inch | 0.0285 sq. inch | 0.0095 sq. inch |
| 9 | Weight Supported lbs. with cutaway (TS × Cross Section Area) | 1653 lbs. | 1102 lbs. | 826.5 lbs. | 275.5 lbs. |

The FEA also considered the deflection of the flashing device channel 222 under an applied load. The analysis showed that 21 pounds of weight applied to the channel 222 of a multifunctional flashing device 200 having a length a of 6" causes approximately 0.072 mm (approximately 0.003 inches) of deflection. For a length a of 3", the corresponding deflection is approximately 0.14 mm (approximately 0.0055 inches). For a length a of 1", the corresponding deflection is approximately 0.42 mm (approximately 0.017 inches). Thus, the FEA indicates that the designs described herein have suitable strength for use in cladding installation applications.

Water Ingress Testing

The multifunctional flashing device 200 of FIGS. 2A-2C was tested using the ASTM-E331 standard to evaluate water movement at the cladding joint between adjacent elements. The stackable clip is intended to be used as a cladding joint flashing where two pieces of lap siding are joined mid-wall. To be considered a cladding joint flashing, the device must prevent water from entering the cavity behind the lap siding. The ASTM-E331-04 test method was used to evaluate the performance of butt joint flashings. In the test, water is sprayed at a test frame. The test assembly was placed 9"

away from a water spray and subjected 12 psi pressure of continuous water spray. The pressure was maintained for 15 minutes. Throughout the duration of the test, the assembly was inspected for any sign of water penetration through the test sample. The water presence was noted from the back side of the wall throughout the test.

Figure 8A:
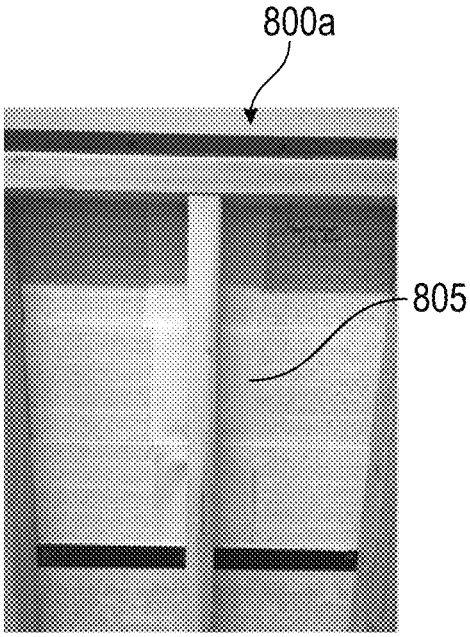
FIGS. 8A and 8B are rear elevation views of lap siding installations with a control flashing and the multifunctional flashing device of FIGS. 2A-2C, respectively.
Figure 8B:
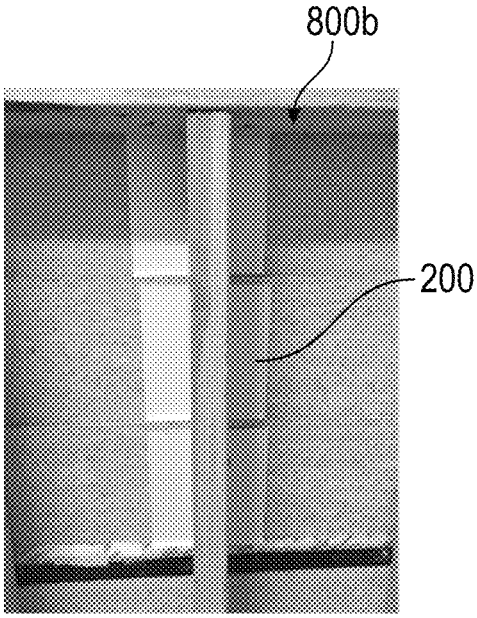
Figure 8C:
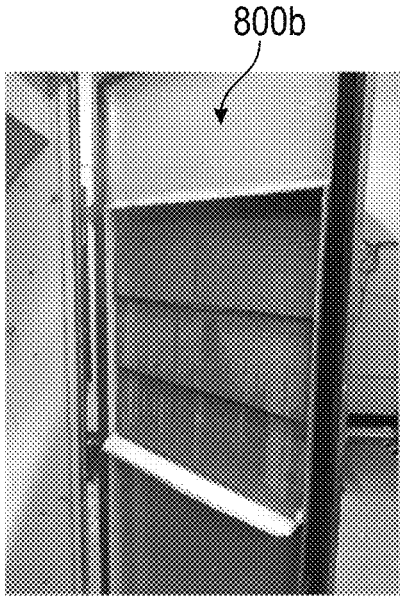
FIG. 8C is a front perspective view of the lap siding installation of FIG. 8B.
Figure 8D:
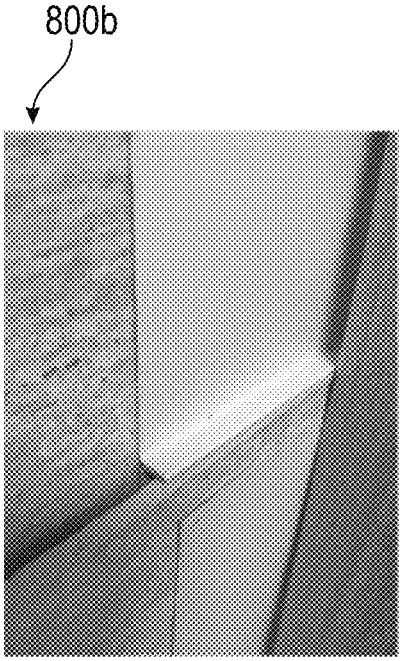
FIG. 8D is a rear perspective view of a portion of the lap siding installation of FIGS. 8B and 8C.
Figure 8E:
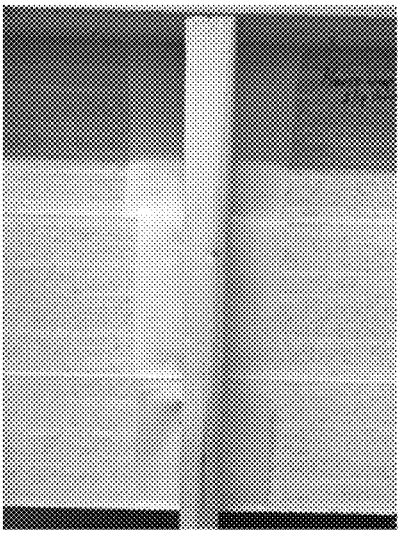
FIGS. 8E and 8F are rear elevation views of the lap siding installations of FIGS. 8A and 8B, respectively, following testing for water ingress.
Figure 8F:
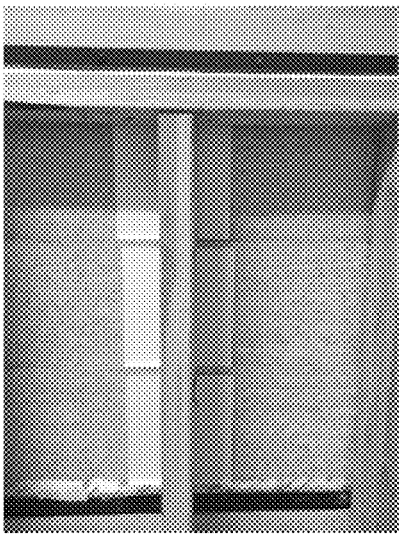

FIG. 8A is a rear view showing the control installation 800*a* including a conventional flashing 805 used in the ASTM-E331 test. FIG. 8B is a rear view showing the test installation 800*b* including the multifunctional flashing device 200 of FIGS. 2A-2C. FIGS. 8C and 8D are front and rear perspective views showing the test installation 800*b* of FIG. 8B during the ASTM-E331 test. FIGS. 8E and 8F are rear views of the lap siding installations 800*a* and 800*b* of FIGS. 8A and 8B, respectively, following testing for water ingress. As shown in FIGS. 8E and 8F, both the multifunctional flashing device 200 and the conventional flashing 805 passed the ASTM-E331 test, indicating that the multifunctional flashing device 200 provides suitable water ingress resistance.

Wind Load Testing

The multifunctional flashing device 100 of FIGS. 1A-1C was tested under a number of different scenarios in accordance with the ASTM E330 standard to evaluate the multifunctional flashing devices' resistance to wind load. Three different wind load scenarios were constructed, using an appropriate test frame in accordance with the requirements of ASTM E330. In each scenario, the multifunctional flashing device 100 was secured to the test frame in series with a plurality of courses of an 8.25" plank siding in a conventional overlapping arrangement as described above with reference to FIGS. 5A-5L. The plank cladding elements were attached with 8D ring-shank nails, blind nailed at 16" off center.

Figure 9:
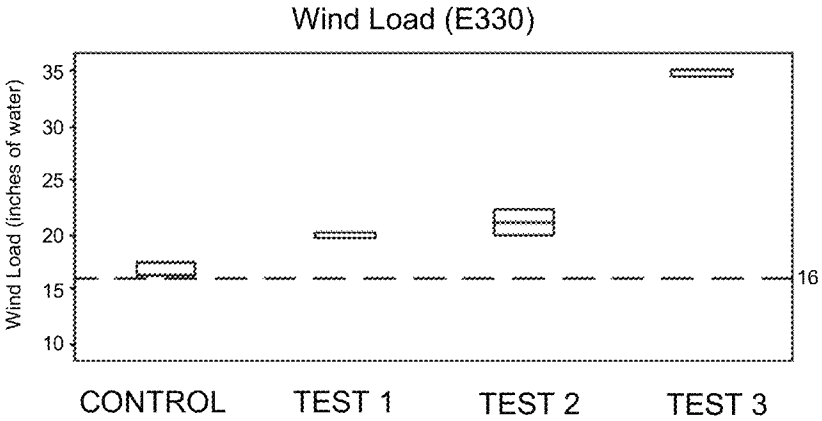
FIG. 9 is a box plot showing the wind load capacities of lap siding installed with the example multifunctional flashing devices described herein, relative to a control.

A control scenario (n=3) applied a standard E330 Wind Load Test. In a first test scenario (n=2), 1 nail was placed through the bottom edge of the flashing through the plank and into the framing. 2 flashing devices were used per course of lap siding. In a second test scenario (n=2), 20 of 30 nails used to secure the lap siding to the test frame were driven through an aluminum flashing, through the lap siding into the test frame. In a third test scenario (n=2), 30 of 30 nails used to secure the lap siding to the test frame were driven through an aluminum flashing, through the lap siding into the test frame. The results of the wind load testing are provided in Table 3 below and in FIG. 9.

TABLE 3

Results of wind load testing of example flashing devices

| CONTROL PSI (inches of water) | TEST ONE PSI (inches of water) | TEST TWO PSI (inches of water) | TEST THREE PSI (inches of water) |
|---|---|---|---|
| 0.588 (16.3) | 0.739 (20.2) | 0.718 (19.9) | 1.245 (34.5) |
| 0.621 (17.2) | 0.711 (19.7) | 0.808 (22.4) | 1.274 (35.3) |
| 0.632 (17.5) | | | |

Figure 10:
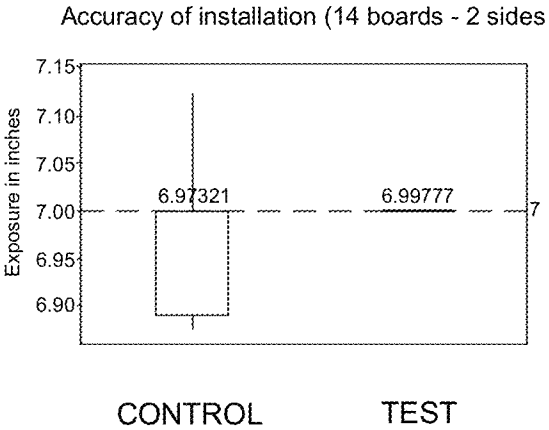
FIG. 10 is a box plot showing the accuracy of installation of lap siding with the multifunctional flashing devices described herein, relative to conventional hand-measured installation methods.

Exposure Accuracy Test:

The multifunctional flashing devices described herein were tested to determine how reliably they positioned a course of lap siding for installation. The multifunctional flashing devices use the top edge of an installed course of lap siding to set the exposure of the next course of lap siding. In some cases, manufactured lap siding boards can vary in width by up to 0.25" between boards. A test wall of lap siding was built using the multifunctional flashing devices described herein and was compared to a control wall of lap siding installed with hand measured exposures. As shown in Table 4 below and in FIG. 10, the multifunctional flashing devices described herein outperformed hand measuring, and accordingly produced no negative impact to the wall aesthetics.

TABLE 4

Results of exposure accuracy testing

| ID | Hand measured | Multifunctional flashing device |
|---|---|---|
| Readings | 28 | 28 |
| Met 7" Target | 18 | 26 |
| Std Dev | 0.064 | 0.024 |

Installation Efficiency Testing

One advantage provided by certain embodiments of the disclosed multifunctional flashing devices is the reduction of time and effort required to install lap siding. To demonstrate the effectiveness of the multifunctional flashing device at reducing installation time, groups of installers installed lap siding to wall sections of varying designs. The experiment required the installers to install lap siding using the multifunctional flashing devices as a test scenario, and to install lap siding by hand using a measuring tape as the control. As shown in Table 5 below, the use of the multifunctional flashing devices resulted in average time savings of approximately 17.25%. Notably, the benefits of the multifunctional flashing devices were especially pronounced when a single installer was performing the installation. Accordingly, the multifunctional flashing devices described herein may allow a single installer to efficiently perform siding installations that were not feasible with fewer than 2 or 3 installers using conventional installation methods.

TABLE 5

Results of installation efficiency testing

| | | | | Normalized to 1-man | | |
|---|---|---|---|---|---|---|
| Installation | Control | Clip | Savings | Control | Clip | Savings |
| 1-man Full | 31 | 15 | 52.0% | 31.0 | 15.0 | 52.0% |
| 2-man Full | 11 | 10 | 9.0% | 5.5 | 5.0 | 4.5% |
| 3-man Full | 10 | 7 | 30.0% | 3.3 | 2.3 | 10.0% |
| 1-man Door-Window | 96 | 66 | 31.0% | 96 | 66 | 31.0% |
| 2-man Door-Window | 49 | 45 | 8.0% | 24.5 | 22.5 | 4.0% |

TABLE 5-continued

| Results of installation efficiency testing | | | | | | |
|---|---|---|---|---|---|---|
| | | | | Normalized to 1-man | | |
| Installation | Control | Clip | Savings | Control | Clip | Savings |
| 3-man Door-Window | 31 | 29 | 6.0% | 10.3 | 9.7 | 2.0% |
| | | | | | Ave. Observed Time Savings | 17.25% |

Among the reasons identified for the observed time savings were the reduced need for measurement and holding of the siding elements. During regular installs, an installer may need to use a tape measure hundreds of times while installing cladding on a single exterior wall. In addition, installers using conventional installation methods may need to hold relatively heavy cladding elements in place for approximately 30 seconds while each cladding element is fastened to the wall. Thus, the multifunctional flashing devices described herein were able to substantially reduce this required time and effort by removing the need to measure the exposure or overlap of cladding elements and hold the cladding elements in place while securing them to the wall.

It will of course be understood that the invention is not limited to the specific details described herein, which are given by way of example only, and that various modifications and alterations are possible within the scope of the disclosure as defined in the appended claims.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as 'can', 'could', 'might', or 'may', unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase 'at least one of X, Y, and Z' unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y, and at least one of Z.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used in conjunction with a multifunctional flashing device that acts as both flashing and as a supporting and/or alignment device, and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. An integrally formed multifunctional flashing device comprising:

a flashing section comprising:

a substantially planar portion having a first end and a second end opposite the first end; and a cladding engagement surface extending from the second end of the substantially planar portion, the cladding engagement surface having a first end adjacent to the second end of the substantially planar portion and a second end opposite the first end of the cladding engagement surface; and a supporting section comprising:

a first side member extending from the second end of the cladding engagement surface away from the substantially planar portion, the first side member having a first end adjacent to the second end of the cladding engagement surface and a second end opposite the first end of the first side member;

a base member extending from the second end of the first side member away from the cladding engagement surface; and a second side member extending from an end of the base member opposite the first side member such that the first side member, the base member, and the second side member define a u-shaped channel sized and shaped to receive a cladding element therein;

the first side member including a breakaway section spaced apart from the second end of the first side member, the breakaway section comprising a locally thin or perforated region of the first side member disposed between the cladding engagement surface and the base member.

2. The integrally formed multifunctional flashing device of claim 1, wherein the integrally formed multifunctional flashing device comprises 24-ga sheet aluminum.

3. The integrally formed multifunctional flashing device of claim 1, wherein the integrally formed multifunctional flashing device comprises a polymeric material having a thickness of approximately 0.1 cm (approximately 0.04 inches).

4. The integrally formed multifunctional flashing device of claim 1, wherein the breakaway section comprises two opposing notches having a depth of approximately 0.025 cm (approximately 0.01 inches).

5. The integrally formed multifunctional flashing device of claim 1, wherein the integrally formed multifunctional flashing device comprises extruded polyvinyl chloride (PVC).

6. The integrally formed multifunctional flashing device of claim 1, wherein the integrally formed multifunctional flashing device comprises extruded polyvinyl chloride (PVC) including an ultraviolet (UV) inhibitor.

7. The integrally formed multifunctional flashing device of claim 1, wherein the breakaway section is spaced between approximately 0.45 cm and approximately 0.5 cm (between approximately 0.18 inches and approximately 0.24 inches) from the second end of the first side member.

8. The integrally formed multifunctional flashing device of claim 1, wherein the cladding engagement surface is disposed at an angle of between 100° and 110° relative to the substantially planar portion.

9. The integrally formed multifunctional flashing device of claim 1, wherein the second side member is disposed at an angle of between 100° and 110° relative to the base member.

10. The integrally formed multifunctional flashing device of claim 1, further comprising one or more flashing fastening apertures extending through the substantially planar portion.

11. A cladding system comprising:

a first course of lap siding comprising at least a first cladding element affixed to a building substrate by a plurality of first mechanical fasteners;

the integrally formed multifunctional flashing device of claim 6 affixed to the building substrate by at least one second mechanical fastener such that the cladding engagement surface lies adjacent to an upper edge of the first cladding element and the first side member lies adjacent to an exterior face of the first cladding element; and a second course of lap siding comprising a second cladding element and a third cladding element, the second cladding element and the third cladding element affixed to the building substrate by a plurality of third mechanical fasteners, the second cladding element and the third cladding element each being partially disposed within the u-shaped channel to form a cladding joint between the second cladding element and the third cladding element.

12. A cladding system comprising:

a first course of lap siding comprising at least a first cladding element affixed to a building substrate by a plurality of first mechanical fasteners;

a multifunctional flashing device affixed to the building substrate by at least one second mechanical fastener, the multifunctional flashing device comprising:

a substantially planar portion parallel to the first cladding element, the substantially planar portion having a top end and a bottom end opposite the top end, the at least one second mechanical fastener passing through the substantially planar portion;

a cladding engagement surface extending in an exterior direction from the bottom end of the substantially planar portion such that the cladding engagement surface lies adjacent to an upper edge of the first cladding element, the cladding engagement surface having an interior end adjacent to the bottom end of the substantially planar portion and an exterior end opposite the first end;

a first side member extending in a downward direction from the exterior end of the cladding engagement surface parallel to the substantially planar portion such that the first side member lies adjacent to an exterior face of the first cladding element; and a u-shaped channel defined by the first side member, a base member extending from a bottom end of the first side member, and a second side member extending upward from an exterior end of the base member; and a second course of lap siding comprising a second cladding element and a third cladding element, the second cladding element and the third cladding element affixed to the building substrate by a plurality of third mechanical fasteners, the second cladding element and the third cladding element each being partially disposed within the u-shaped channel to form a cladding joint between the second cladding element and the third cladding element;

wherein the first side member further includes a breakaway section comprising one or more notches or grooves located therein, the breakaway section disposed between the cladding engagement surface and the base member, the multifunctional flashing device configured to be separated along the breakaway section to form a permanent flashing for the cladding joint.

13. The cladding system of claim 12, wherein the one or more notches or grooves have a depth of approximately 0.025 cm (approximately 0.01 inches).

14. The cladding system of claim 12, wherein the multifunctional flashing device comprises formed 24-ga sheet aluminum or a polymeric material.

15. The cladding system of claim 12, wherein the multifunctional flashing device comprises extruded polyvinyl chloride (PVC) including an ultraviolet (UV) inhibitor.

16. A cladding system comprising:

a first course of lap siding comprising at least a first cladding element affixed to a building substrate by a plurality of first mechanical fasteners;

a multifunctional flashing device affixed to the building substrate by at least one second mechanical fastener, the multifunctional flashing device comprising:

a substantially planar portion parallel to the first cladding element, the substantially planar portion having a top end and a bottom end opposite the top end, the at least one second mechanical fastener passing through the substantially planar portion;

a cladding engagement surface extending in an exterior direction from the bottom end of the substantially planar portion such that the cladding engagement surface lies adjacent to an upper edge of the first cladding element, the cladding engagement surface having an interior end adjacent to the bottom end of the substantially planar portion and an exterior end opposite the first end;

a first side member extending in a downward direction from the exterior end of the cladding engagement surface parallel to the substantially planar portion such that the first side member lies adjacent to an exterior face of the first cladding element; and a u-shaped channel defined by the first side member, a base member extending from a bottom end of the first side member, and a second side member extending upward from an exterior end of the base member; and a second course of lap siding comprising a second cladding element and a third cladding element, the second cladding element and the third cladding element affixed to the building substrate by a plurality of third mechanical fasteners, the second cladding element and the third cladding element each being partially disposed within the u-shaped channel to form a cladding joint between the second cladding element and the third cladding element;

wherein the first side member further includes a breakaway section comprising a plurality of laser cut perforations extending through the first side member, the breakaway section disposed between the cladding engagement surface and the base member, the multifunctional flashing device configured to be separated along the breakaway section to form a permanent flashing for the cladding joint.

17. The cladding system of claim 16, wherein the multifunctional flashing device comprises formed 24-ga sheet aluminum or a polymeric material.

18. The cladding system of claim 16, wherein the multifunctional flashing device comprises extruded polyvinyl chloride (PVC) including an ultraviolet (UV) inhibitor.

19. A method of installing lap siding, the method comprising:

obtaining the integrally formed multifunctional flashing device of claim 1, the flashing section configured to serve as a flashing for a cladding joint, the supporting section configured to support one or more lap siding boards at a predetermined overlap spacing;

positioning the multifunctional flashing device against a building substrate such that the flashing section abuts the building substrate and an upper edge of an installed course of lap siding;

affixing the multifunctional flashing device to the building substrate by inserting one or more mechanical fasteners through the multifunctional flashing device;

positioning a first cladding element within the supporting section such that the supporting section at least partially retains the first cladding element in an installation configuration;

affixing the first cladding element to the building substrate by inserting one or more mechanical fasteners through the first cladding element; and separating the supporting section from the flashing section via the breakaway section such that the flashing section is retained between the building substrate and the first cladding element.

20. The method of claim 19, further comprising:

obtaining a second integrally formed multifunctional flashing device comprising a flashing section and a supporting section;

positioning the second multifunctional flashing device against the building substrate such that the flashing section abuts the building substrate and the upper edge of the installed course of lap siding at a location spaced from the multifunctional flashing device by a height of the first cladding element; and affixing the second multifunctional flashing device to the building substrate;

wherein the first cladding element is supported by the multifunctional flashing device and the second multifunctional flashing device in an installation position with a predetermined overlap relative to the installed course of lap siding.

21. The method of claim 19, wherein separating the supporting section comprises applying a rotational force to the supporting section such that the multifunctional flashing device is broken at the breakaway section.

22. The method of claim 19, further comprising, prior to separating the supporting section:

positioning a second cladding element within the supporting section such that the supporting section at least partially retains the second cladding element in an installation configuration; and affixing the second cladding element to the building substrate by inserting one or more mechanical fasteners through the second cladding element such that the first cladding element abuts the second cladding element to form a cladding joint.

23. The method of claim 22, wherein the retained flashing section is concealed from view by the first cladding element and the second cladding element.

* * * * *